US009151261B2

(12) United States Patent
Roussel

(10) Patent No.: US 9,151,261 B2
(45) Date of Patent: Oct. 6, 2015

(54) FUNCTIONAL MODULE THAT INTEGRATES A DISTRIBUTOR AND A FUEL RAIL AND PROCESS FOR ITS PRODUCTION

(75) Inventor: Jerome Roussel, Colmar (FR)

(73) Assignee: SYSTEMES MOTEURS, Guyancourt (FR)

( * ) Notice: Subject to any disclaimer, the term of this patent is extended or adjusted under 35 U.S.C. 154(b) by 766 days.

(21) Appl. No.: 13/497,644

(22) PCT Filed: Sep. 22, 2010

(86) PCT No.: PCT/FR2010/051994

§ 371 (c)(1),
(2), (4) Date: Jul. 27, 2012

(87) PCT Pub. No.: WO2011/036410

PCT Pub. Date: Mar. 31, 2011

(65) Prior Publication Data

US 2012/0298076 A1 Nov. 29, 2012

(30) Foreign Application Priority Data

Sep. 22, 2009 (FR) ..... 09 56517

(51) Int. Cl.
*F02M 69/46* (2006.01)
*F02M 35/10* (2006.01)
*F02M 61/14* (2006.01)

(52) U.S. Cl.
CPC ..... *F02M 69/465* (2013.01); *F02M 35/10078* (2013.01); *F02M 35/10216* (2013.01);
(Continued)

(58) Field of Classification Search
CPC ..... F02M 35/10078; F02M 69/465; F02M 61/145; F02M 35/10216; F02M 35/10354; F02M 35/10242; F02M 61/14; F02M 35/104; B21D 53/84
USPC ..... 123/470, 184.21, 456; 29/888.01, 428
See application file for complete search history.

(56) References Cited

U.S. PATENT DOCUMENTS 4,751,904 A * 6/1988 Hudson, Jr. ..... 123/470
4,798,187 A * 1/1989 Hudson, Jr. ..... 123/469
(Continued)

FOREIGN PATENT DOCUMENTS

EP 0403871 * 12/1990 ..... F02M 69/465
EP 1270917 1/2003
(Continued)

OTHER PUBLICATIONS

International Search Report dated Jan. 17, 2011, in corresponding PCT application.

*Primary Examiner* — Stephen K Cronin
*Assistant Examiner* — John Bailey
(74) *Attorney, Agent, or Firm* — Young & Thompson

(57) ABSTRACT

A functional module integrates a distributor with a plenum and several pipes that form a common attachment and connection plate, a fuel rail, and a holding part for ensuring the locking in position of the fuel rail. The functional module (1) is characterized in that it consists of an interlocked and nested arrangement that includes the distributor (2), the fuel rail (7), and the holding part (9), with the fuel rail (7) being held between the holding part (9) and the distributor (2), and in that the holding part (9) and the distributor form by cooperation a longitudinal receiving housing with the possibility of locking the fuel rail (7) whose introduction opening is defined between an arrangement of feet (10) of the holding part (9) and the plate (5) of the pipes (4).

20 Claims, 28 Drawing Sheets

(52) U.S. Cl.
CPC ... *F02M35/10242* (2013.01); *F02M 35/10354* (2013.01); *F02M 61/145* (2013.01); *Y10T 29/49231* (2015.01); *Y10T 29/49826* (2015.01)

(56) References Cited

U.S. PATENT DOCUMENTS

| | | | | | |
|---|---|---|---|---|---|
| 4,805,564 | A * | 2/1989 | Hudson, Jr. | 123/184.42 |
| 4,913,119 | A * | 4/1990 | Usui | 123/456 |
| 4,966,120 | A * | 10/1990 | Itoh et al. | 123/516 |
| 4,971,014 | A * | 11/1990 | Usui | 123/470 |
| 4,996,961 | A * | 3/1991 | Usui | 123/456 |
| 4,996,962 | A * | 3/1991 | Usui | 123/456 |
| 5,002,030 | A * | 3/1991 | Mahnke | 123/469 |
| 5,022,371 | A * | 6/1991 | Daly | 123/468 |
| 5,022,372 | A * | 6/1991 | Imura et al. | 123/469 |
| 5,072,710 | A * | 12/1991 | Washizu | 123/470 |
| 5,097,594 | A * | 3/1992 | Daly et al. | 29/888.01 |
| 5,160,691 | A * | 11/1992 | Daly | 264/334 |
| 5,197,436 | A * | 3/1993 | Ozawa | 123/456 |
| 5,357,931 | A * | 10/1994 | Semence | 123/456 |
| 5,408,971 | A * | 4/1995 | Jaeger et al. | 123/456 |
| 5,513,613 | A * | 5/1996 | Taylor et al. | 123/456 |
| 5,568,798 | A * | 10/1996 | Lorraine | 123/456 |
| 5,577,477 | A * | 11/1996 | Katoh | 123/456 |
| 5,617,827 | A * | 4/1997 | Eshleman et al. | 123/456 |
| 5,718,206 | A * | 2/1998 | Sawada et al. | 123/470 |
| 5,806,494 | A * | 9/1998 | Glassey | 123/456 |
| 6,178,950 | B1 * | 1/2001 | Stockner et al. | 123/470 |
| 6,269,797 | B1 * | 8/2001 | Uchida | 123/469 |
| 6,371,083 | B1 * | 4/2002 | Rossi et al. | 123/456 |
| 6,374,806 | B1 * | 4/2002 | Keeley et al. | 123/456 |
| 6,470,859 | B2 * | 10/2002 | Imura et al. | 123/467 |
| 6,553,980 | B1 * | 4/2003 | Nally et al. | 123/585 |
| 6,564,775 | B1 * | 5/2003 | Kikuta et al. | 123/456 |
| 6,640,783 | B2 * | 11/2003 | Braun et al. | 123/467 |
| 6,644,279 | B1 * | 11/2003 | Frank et al. | 123/447 |
| 6,725,839 | B2 * | 4/2004 | Zdroik et al. | 123/456 |
| 6,886,537 | B2 * | 5/2005 | Kondo | 123/468 |
| 6,959,695 | B2 * | 11/2005 | Warner et al. | 123/456 |
| 7,159,569 | B2 * | 1/2007 | Keegan et al. | 123/456 |
| 7,334,571 | B1 * | 2/2008 | Beardmore et al. | 123/470 |
| 8,596,246 | B2 * | 12/2013 | Nishizawa et al. | 123/469 |
| 8,631,784 | B2 * | 1/2014 | Brand et al. | 123/469 |
| 8,794,215 | B2 * | 8/2014 | Hirano et al. | 123/468 |
| 2002/0083924 | A1 * | 7/2002 | Murphy | 123/468 |
| 2003/0015170 | A1 * | 1/2003 | Klotz et al. | 123/306 |
| 2003/0106525 | A1 * | 6/2003 | Morgillo et al. | 123/336 |
| 2003/0140897 | A1 * | 7/2003 | Zehnal et al. | 123/456 |
| 2003/0172911 | A1 * | 9/2003 | Nishiwaki et al. | 123/456 |
| 2003/0230283 | A1 * | 12/2003 | Vanderveen et al. | 123/456 |
| 2003/0230285 | A1 * | 12/2003 | Lee et al. | 123/470 |
| 2004/0118382 | A1 * | 6/2004 | Usui et al. | 123/456 |
| 2005/0166898 | A1 * | 8/2005 | Braeuer et al. | 123/456 |
| 2005/0217643 | A1 * | 10/2005 | Limbrunner | 123/470 |
| 2006/0000437 | A1 * | 1/2006 | Kito et al. | 123/184.21 |
| 2007/0084436 | A1 * | 4/2007 | Hiraya et al. | 123/305 |
| 2007/0144491 | A1 * | 6/2007 | Ueda | 123/470 |
| 2007/0163545 | A1 * | 7/2007 | Beardmore et al. | 123/456 |
| 2007/0221176 | A1 * | 9/2007 | Hardy | 123/470 |
| 2008/0041343 | A1 * | 2/2008 | Parish, Jr. | 123/470 |
| 2009/0084358 | A1 * | 4/2009 | Zdroik | 123/470 |
| 2009/0159049 | A1 * | 6/2009 | Sakagami et al. | 123/456 |
| 2009/0188470 | A1 * | 7/2009 | Rettig | 123/470 |
| 2009/0212134 | A1 * | 8/2009 | Drake et al. | 239/533.3 |
| 2010/0012093 | A1 * | 1/2010 | Pepperine et al. | 123/470 |
| 2010/0018491 | A1 * | 1/2010 | Fornara et al. | 123/184.21 |
| 2010/0024406 | A1 * | 2/2010 | Pollitt et al. | 60/310 |
| 2010/0071668 | A1 * | 3/2010 | Biasci et al. | 123/470 |
| 2010/0095934 | A1 * | 4/2010 | Hasegawa et al. | 123/447 |
| 2010/0275883 | A1 * | 11/2010 | Hohkita et al. | 123/456 |
| 2010/0300406 | A1 * | 12/2010 | Harvey et al. | 123/456 |
| 2010/0300409 | A1 * | 12/2010 | Harvey et al. | 123/470 |
| 2010/0313851 | A1 * | 12/2010 | Di Domizio et al. | 123/470 |

FOREIGN PATENT DOCUMENTS

| | | | | |
|---|---|---|---|---|
| EP | 1240423 | | 3/2004 | |
| EP | 2042724 | A1 * | 4/2009 | F02M 35/104 |
| FR | 2779681 | | 12/1999 | |

* cited by examiner

FUNCTIONAL MODULE THAT INTEGRATES A DISTRIBUTOR AND A FUEL RAIL AND PROCESS FOR ITS PRODUCTION

BACKGROUND OF THE INVENTION

1. Field of the Invention

This invention relates to the field of equipment and accessories for internal combustion engines, more particularly those supplied by high-pressure fuel rails.

The object of the invention is more particularly a functional module that integrates a distributor and a fuel rail as well as a process for the production of such a module.

In the vehicles with internal combustion engines, of which the different pistons are supplied by a common fuel rail, the latter is often located close to the distributor in the immediate surroundings of the engine, with these two accessories also having to be made rigidly integral with the engine block.

It was consequently obvious for one skilled in the art to attempt to connect these two accessories to one another so that they form a structural unit that has internal cohesion and can be made integral together with the engine block. Various solutions in this direction have already been formulated and presented.

2. Description of the Related Art

It has thus been proposed to mount the fuel rail on the distributor, for example by the document FR 2 779 681.

In this document, the two accessories are connected to one another by a quick-action coupling.

Nevertheless, an indirect attachment of the fuel rail on the engine block through the distributor is necessarily less rigid and less resistant than a direct attachment and also in addition stresses at least a part of said distributor, as well as its attachment points.

It has also been proposed to attach the distributor and the fuel rail in a combined manner at the same attachment points while ensuring a mechanical connection between the two elements.

Thus, the document EP 1 240 423 discloses a combined distributor-fuel rail unit in which said rail is provided with annular extensions in the form of blank holders that each fits tightly around a distributor pipe. These blank holders that are formed on the rail are equipped with tubular support feet for the passage of attachment screws, which line up with the openings for attachment of the connection plate of the pipes and that come into contact under pressure on said plate at said openings during the mounting on the engine block.

In another embodiment that is disclosed by this document, the blank holders are made of a single independent part that is not equipped with support feet, just covering the connection plate of the pipes and closing from the top the housing for receiving the rail in the plate.

In the two embodiments, the set of attachment points of the plate of the pipes and blank holders are combined, and the latter are not in direct support on the engine block, but rather rest on the plate that they make integral and flatten by clamping, also using the rail, against said engine block.

As a result, the attachment of the blank holders and the attachment of the pipes are totally interdependent, and the fuel rail itself participates in the mounting with locking of said pipes on the engine block.

Such a design nevertheless produces a complex structure for the fuel rail when it is formed integral with the blank holders.

In addition, these known embodiments impose a forced configuration for the connection plate of the pipes for the purpose of ensuring that the support feet of the blank holders and the attachment openings of the plate of the pipes line up completely. The result may be an implantation of the attachment sites of the connection plate that is not optimized in terms of strains and stresses, especially since this plate is assembled with the intake manifold, whose positioning in space of the main body can be shifted or offset relative to that of the plate.

Furthermore, stressing the fuel rail to participate positively in making the plate of the pipes integral on the engine block generates mechanical strains on this rail that can be detrimental over time to its structural integrity, taking into account in particular the vibratory context.

Finally, a forced disengagement of the plate of the pipes during disengagement or disassembly of the holding part may not be desirable in certain contractive configurations and may even be detrimental, for example in terms of time loss and problems during reassembly and/or sealing.

BRIEF SUMMARY OF THE INVENTION

This invention in particular has as its object to remedy at least some, and preferably all, of the above-mentioned drawbacks.

For this purpose, the invention has as its object a functional module that integrates, on the one hand, an inlet distributor or intake manifold with a mixing/distribution chamber or plenum and several pipes that extend laterally from said chamber and are physically connected to one another at their outlet openings to form a common attachment and connection plate that is airtight to the cylinder heads of an internal combustion engine, optionally equipped with means for regulating flow at the outlet openings, and, on the other hand, a high-pressure fuel rail in the form of a pipe that is equipped with several lateral housings for injectors, and, finally, a holding part for locking said fuel rail in position, Whereby said functional module consists of an interlocked and nested arrangement that comprises the distributor, the fuel rail, and the holding part, with the fuel rail being held between the holding part and the distributor, A functional module that is characterized In that the holding part is designed to rest directly on and to be made integral with the engine block and comprises first and second groups of support and attachment feet each extending respectively on either side of the common plate of the pipes, In that the support and attachment feet of the two groups are connected to one another by a formation of material that constitutes a bridge, In that at least a portion of said bridge, with one of the groups of the support and attachment feet forming an alignment some distance from the plate, and a portion of the lateral wall of said attachment and connection plate and/or wall portions of the different pipes form together by cooperation a longitudinal housing for receiving with locking of the fuel rail, and In that the distributor is equipped, on the one hand, in particular at the attachment and connection plate, with specific points or sites for attachment on the engine block, separate from the attachment points of the support and attachment feet of the holding part, and, on the other hand, upper additional attachment feet that extend some distance from the plate and line up with and come to rest on the support and attachment feet of the first group of the holding part, in the assembled state of the arrangement that forms the functional module.

BRIEF DESCRIPTION OF THE DRAWINGS

The invention will be better understood owing to the description below, which relates to a preferred embodiment, given by way of nonlimiting example and explained with reference to the accompanying diagrammatic drawings, in which.

In the form of transverse cutaway views along a cutting plane that passes through a support and attachment foot of the second group of the holding part.

DETAILED DESCRIPTION OF THE PREFERRED EMBODIMENTS

Figure 3:
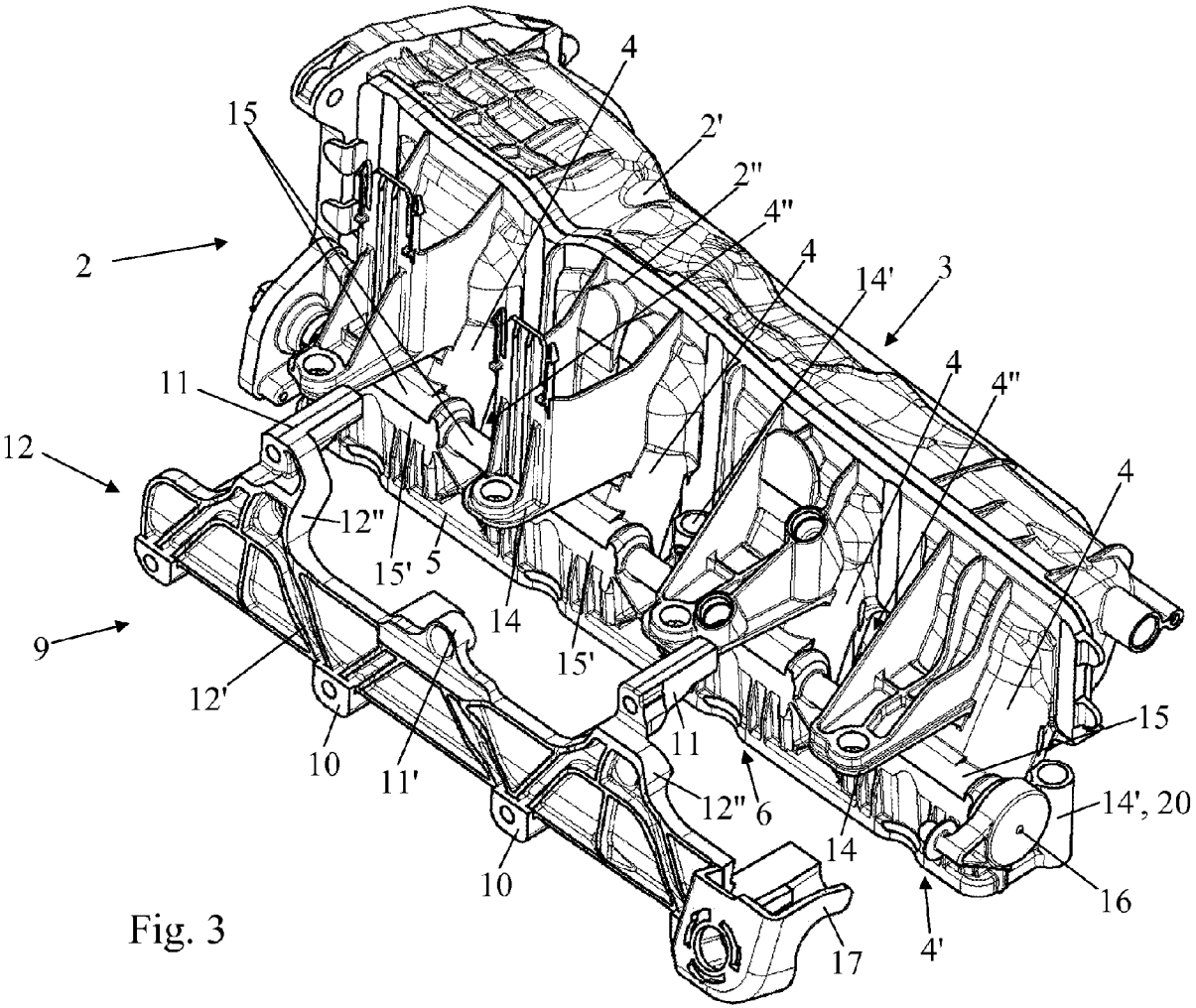
FIG. 3 is an exploded perspective view that shows a distributor 2 and a holding part 9 that are part of a variant of the module that is shown in FIGS. 1 and 2, before their assembly.
Figure 9A:
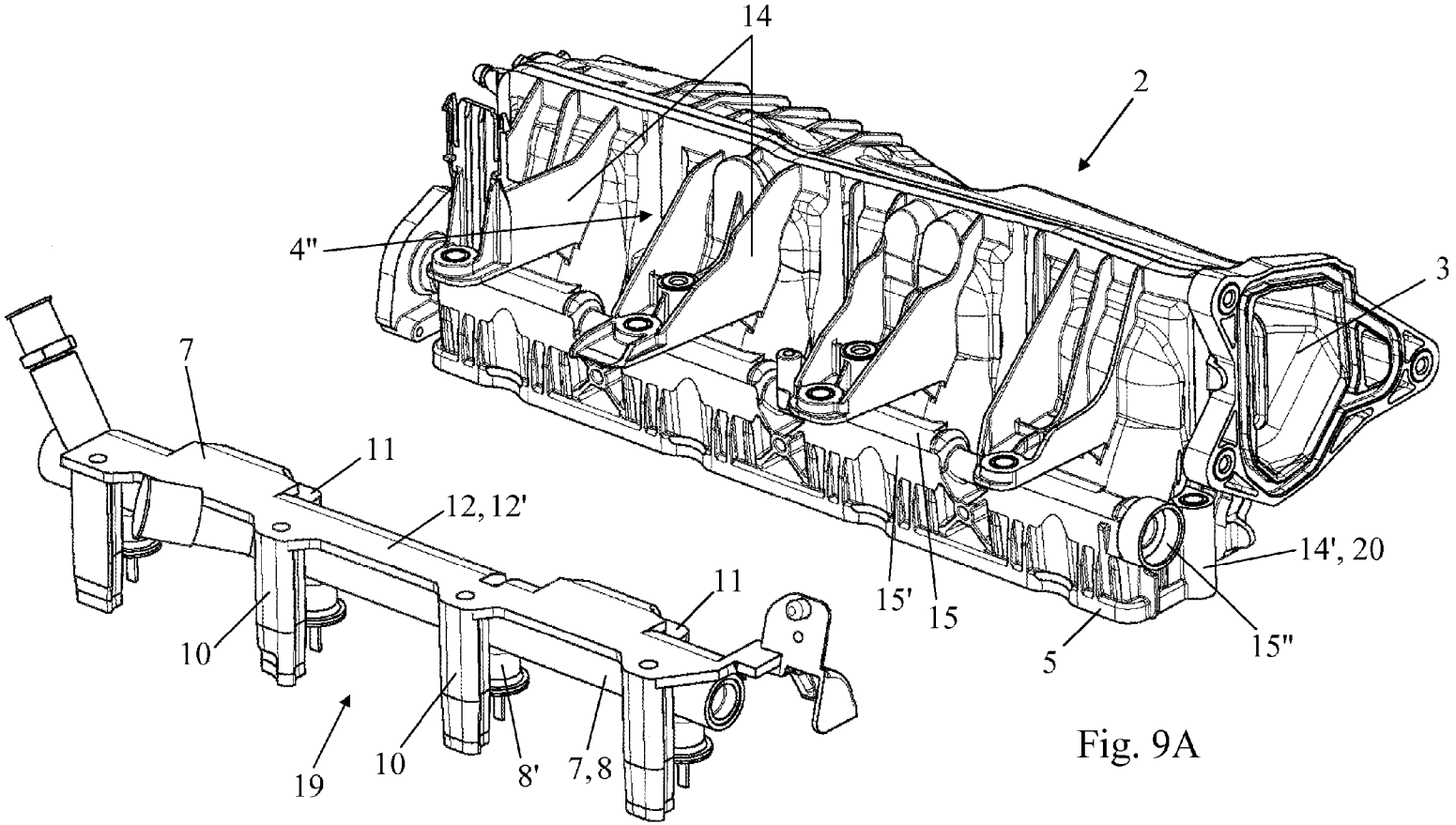
FIGS. 9A and 9B are respectively views that are similar to those of FIGS. 8A and 8B, illustrating a third embodiment of the invention.
Figure 9B:
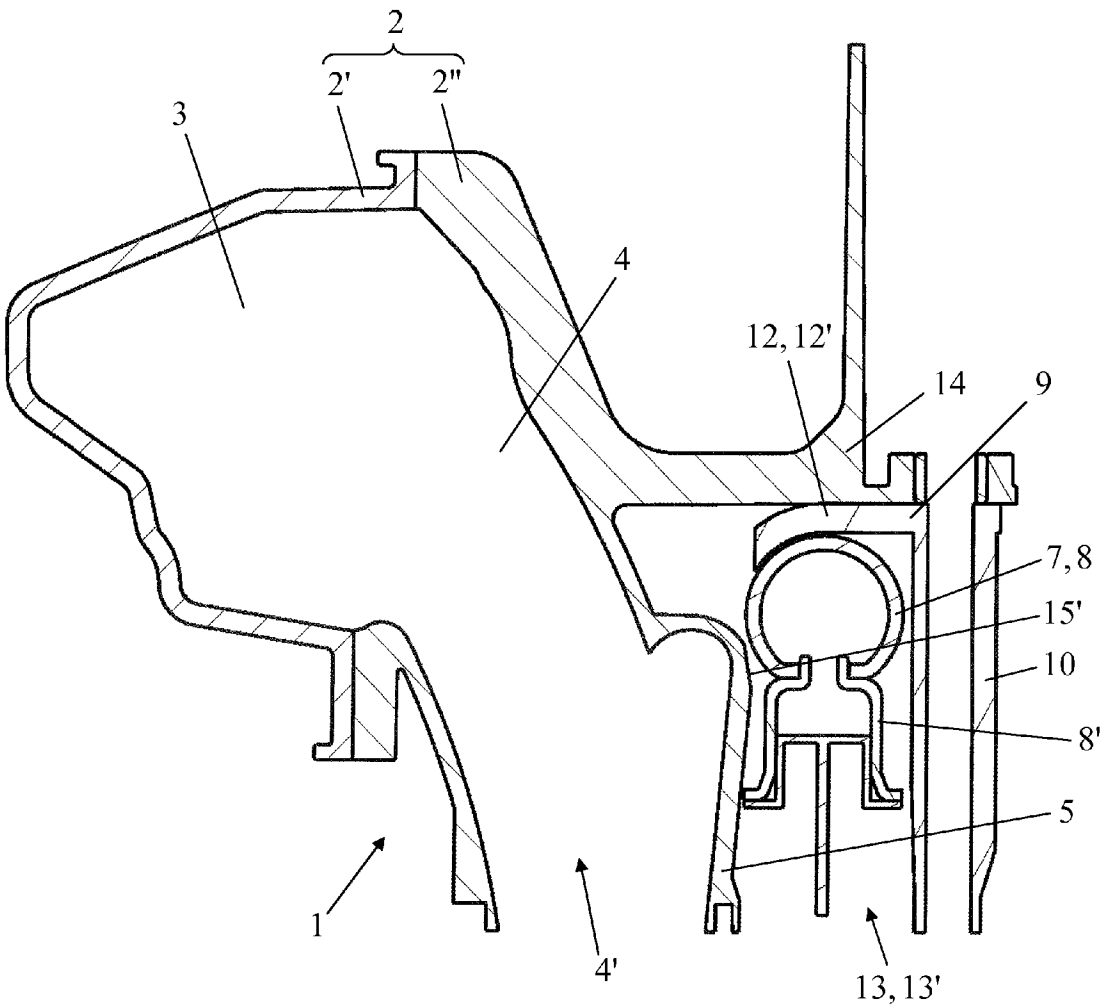
Figure 10:
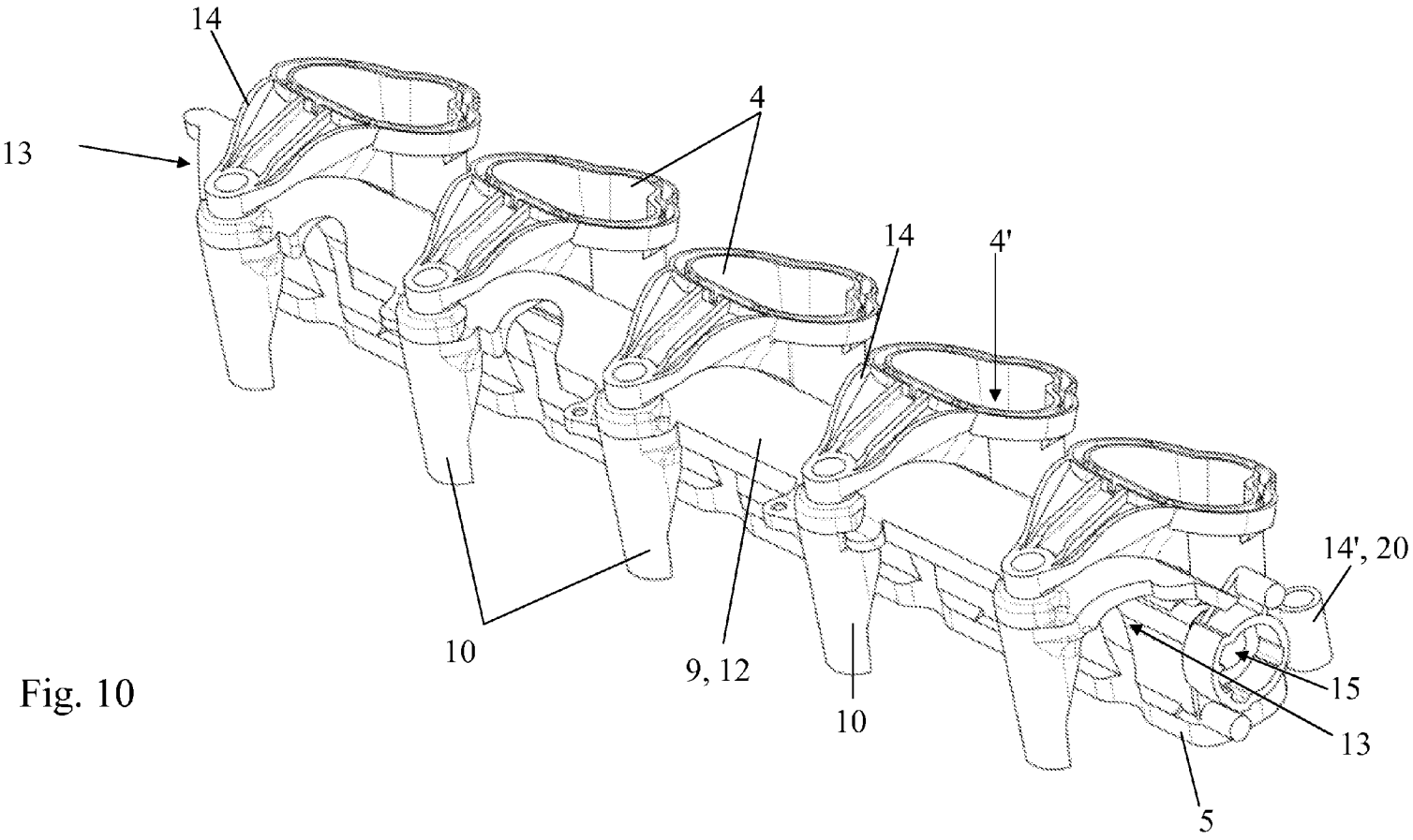
FIG. 10 is a perspective view that partially illustrates (without the fuel rail) a fourth embodiment of the module according to the invention in which the body of the distributor (not shown) and the connection and attachment plate of the pipes consist of two parts that are produced separately and assembled in an airtight manner at the different pipes.
Figure 11:
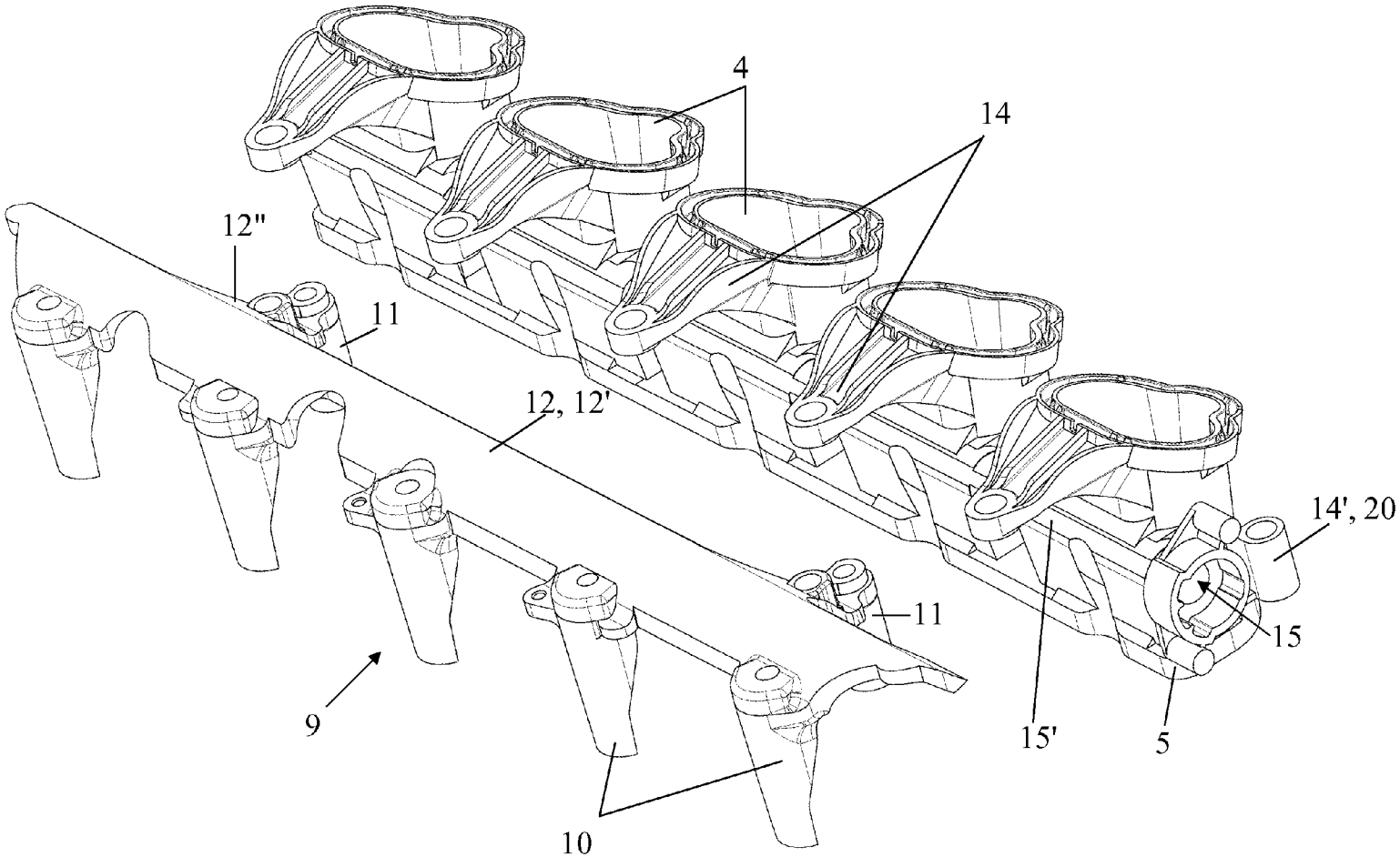
FIG. 11 is a perspective view that illustrates the two components of the unit (plate—holding part) of FIG. 10 before assembly.

FIGS. 1, 5 to 9, 12 and partially FIGS. 3, 10, and 11 show a functional module 1 that integrates, on the one hand, an inlet distributor or intake manifold 2 with a mixing/distribution chamber or plenum 3 and several pipes 4 that extend laterally from said chamber 3 and are physically connected to one another at their outlet openings 4' to form a common attachment and connection plate 5 that is airtight to the cylinder heads of an internal combustion engine, optionally equipped with means or elements 6 for regulating the flow at the outlet openings 4', and, on the other hand, a high-pressure fuel rail 7 in the form of a pipe 8 that is equipped with several lateral housings 8' for injectors, and, finally, a holding part 9 for ensuring the locking in position of said fuel rail 7.

This functional module 1 consists of an interlocked and nested arrangement that comprises the distributor 2, the fuel rail 7, and the holding part 9, with the fuel rail 7 being held between the holding part 9 and the distributor 2.

In accordance with the invention, the holding part 9 is designed to rest directly on and to be made integral with the engine block, and it comprises first and second groups of support and attachment feet 10, 11, each extending respectively on both sides of the common plate 5 of the pipes 4.

In addition, the support and attachment feet 10 and 11 of the two groups are connected to one another by a formation of material that constitutes a bridge 12, and at least a portion of said bridge 12, with one of the groups of support and attachment feet 10 forming an alignment some distance from the plate 5, and a portion of the lateral wall of said attachment and connection plate 5 and/or portions of wall 15' of different pipes 4 together form by cooperation a longitudinal receiving housing 13 with locking of the fuel rail 7.

In addition, the distributor 2 is equipped, in particular at the attachment and connection plate, on the one hand, with attachment points or sites 20 that are selective and separate from the attachment points of the support and attachment feet 10 and 11 of the holding part 9, and, on the other hand, upper additional attachment feet 14 that extend some distance from the plate 5 and line up with and rest on the support and attachment feet 10 of the first group of the holding part 9, in the assembled state of the arrangement that forms the functional module 1.

Thus, the fuel rail 7 is held in a reliable manner in a receiving housing 13 that can extend over the entire length of said rail 7, and the implementation of a separate holding part 9 makes it possible to limit the structural complexity of the rail 7 and the distributor 2.

In addition, the fuel rail 7 does not participate in the attachment of the distributor 2 and is therefore not stressed in terms of strains to this end.

Finally, the differentiation of at least some of the attachment points of the holding part, on the one hand, and of the distributor, or at least the plate 5, on the other hand, makes it possible to preserve a certain structural freedom for these two elements, to select the best points and sites of attachment for each of them (location, shape of feet, shape of eyelets or flanges, . . . ) and to decouple the mounting/removal operations between these two elements.

In accordance with an advantageous embodiment, the bridge of material 12 consists of a wing-shaped body 12' with an essentially continuous structure, laterally adjacent to the support and attachment feet 10 of the first group and comprising several projections 12" that extend up to the support and attachment feet 11 of the second group, whereby these projections 12" each extend through a passage or space 4" that is released between two consecutive pipes 4, this in the assembled state for the purpose of mounting the arrangement that forms the functional module 1, by preferably being interlocked between these pipes 4 with locking in position by cooperation of complementary shapes.

Thus, from complementary conformations of the projections 12" and pipes 4, a mechanical coupling of the holding part 9 and the distributor 2 results, locking these two components to one another at least in the longitudinal direction that is defined by the alignment of the pipes 4 and the fuel rail 7.

According to one characteristic of the invention and as FIGS. 1 to 7, 8A, 9A, 12, 14 and 15A of the accompanying drawings show, the feet 10, 11 of the first and second groups have a structure of tubular eyelets for the passage of attachment screws and the offset positioning of the bridge of material 12 relative to said plate 5.

Figure 1A:
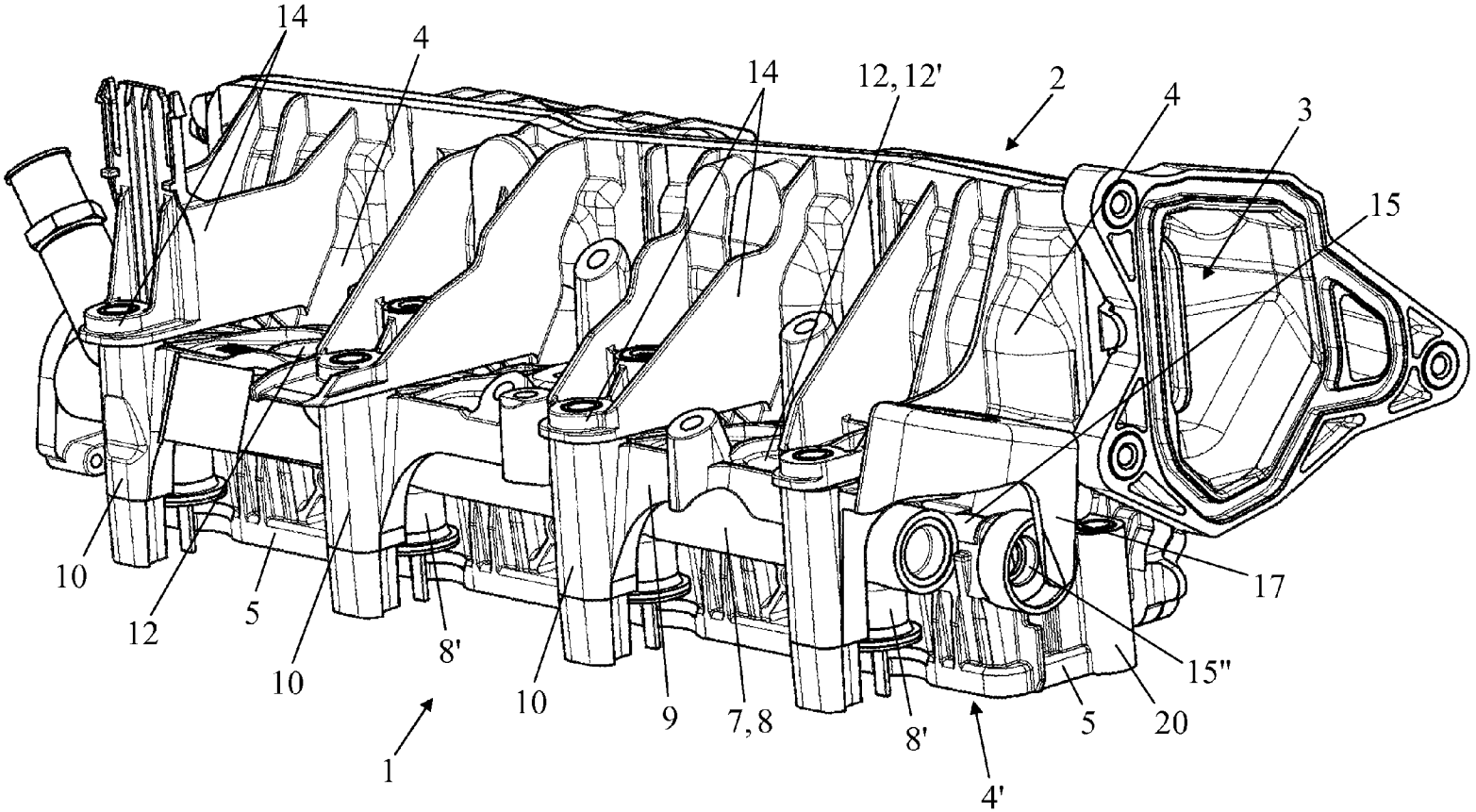
FIGS. 1A and 1B are perspective views in two different directions of a combined functional module according to a first embodiment of the invention.
Figure 1B:
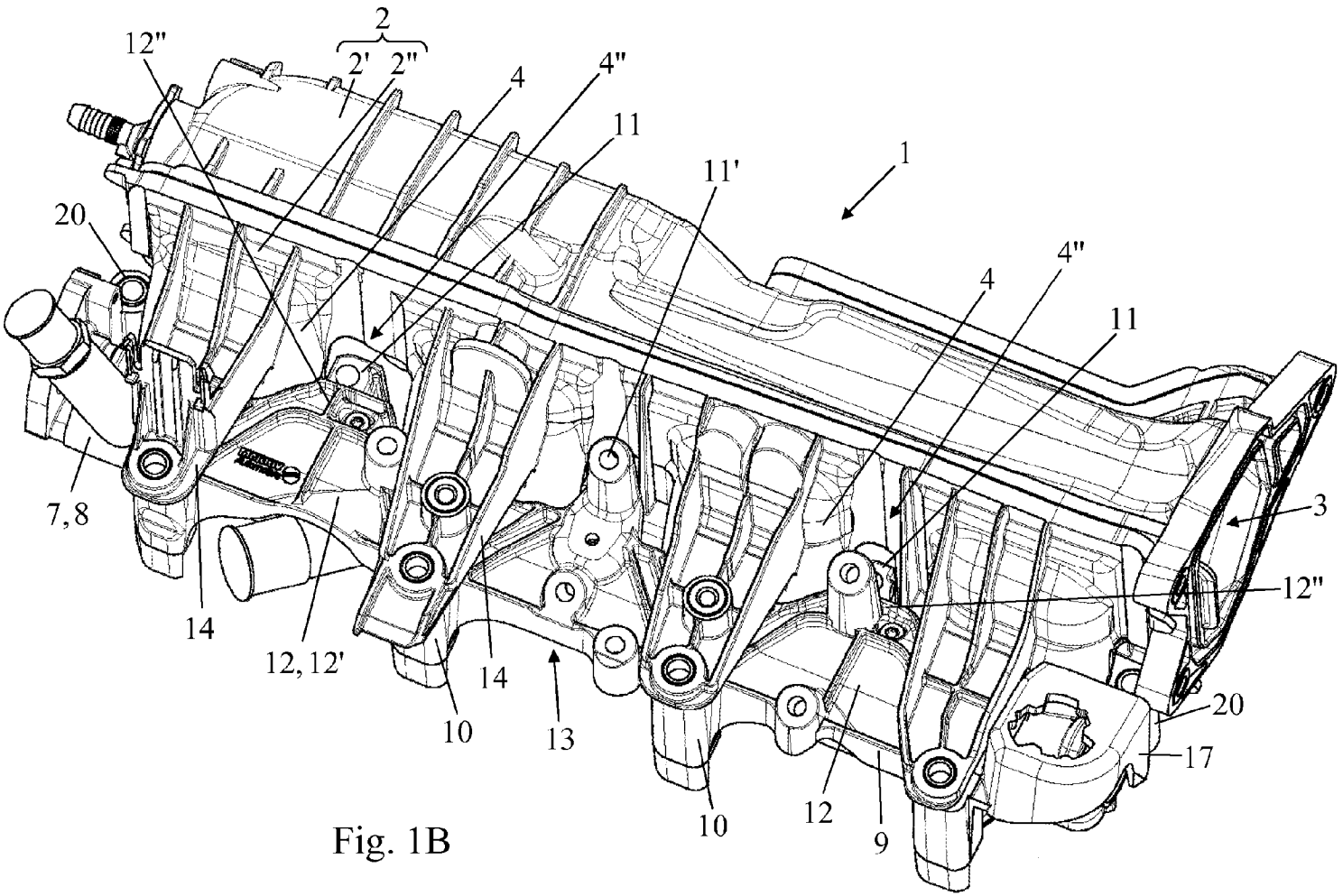
Figure 2A:
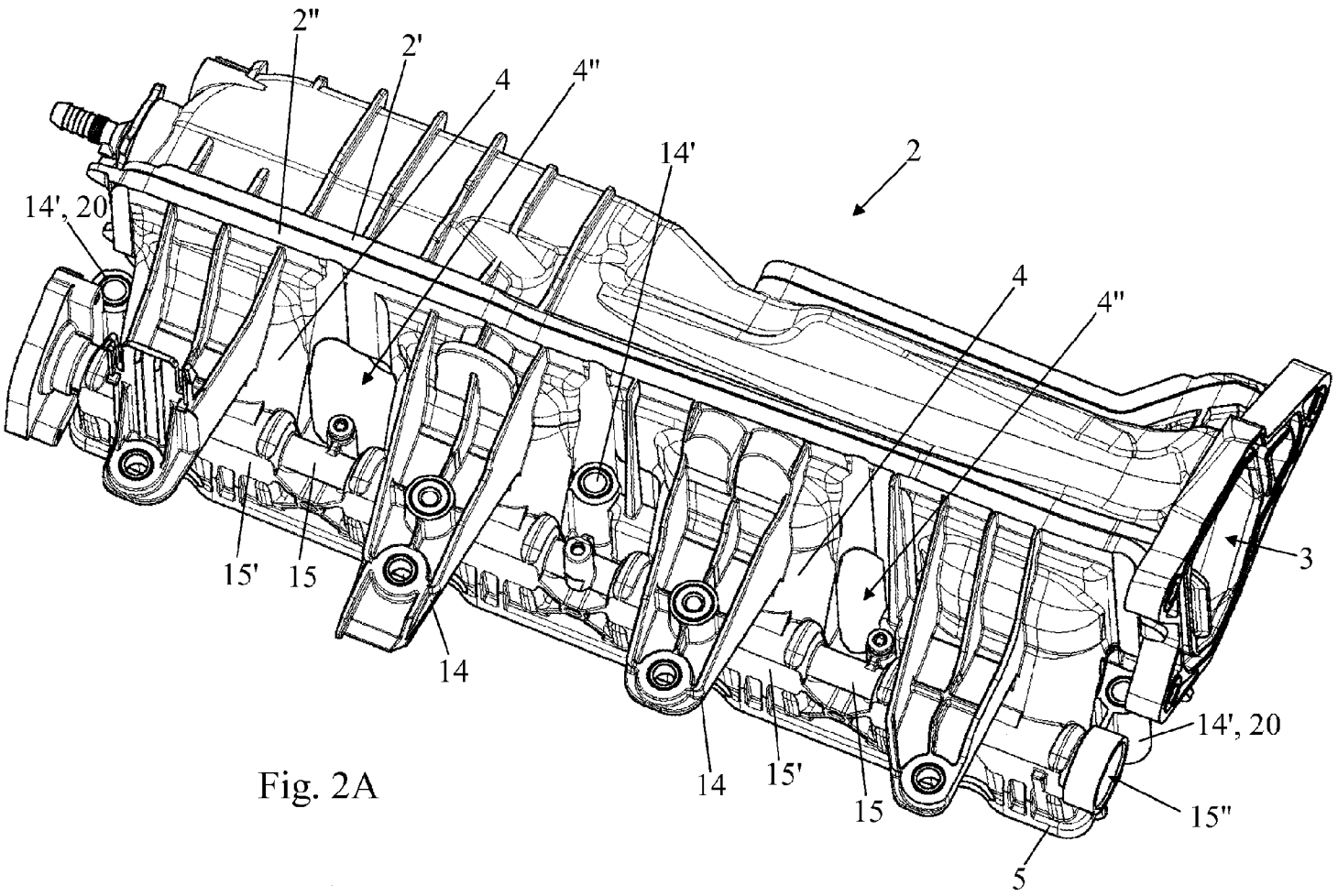
FIG. 2A is a perspective view of the inlet distributor that is part of the module that is shown in FIGS. 1A and 1B.
Figure 2B:
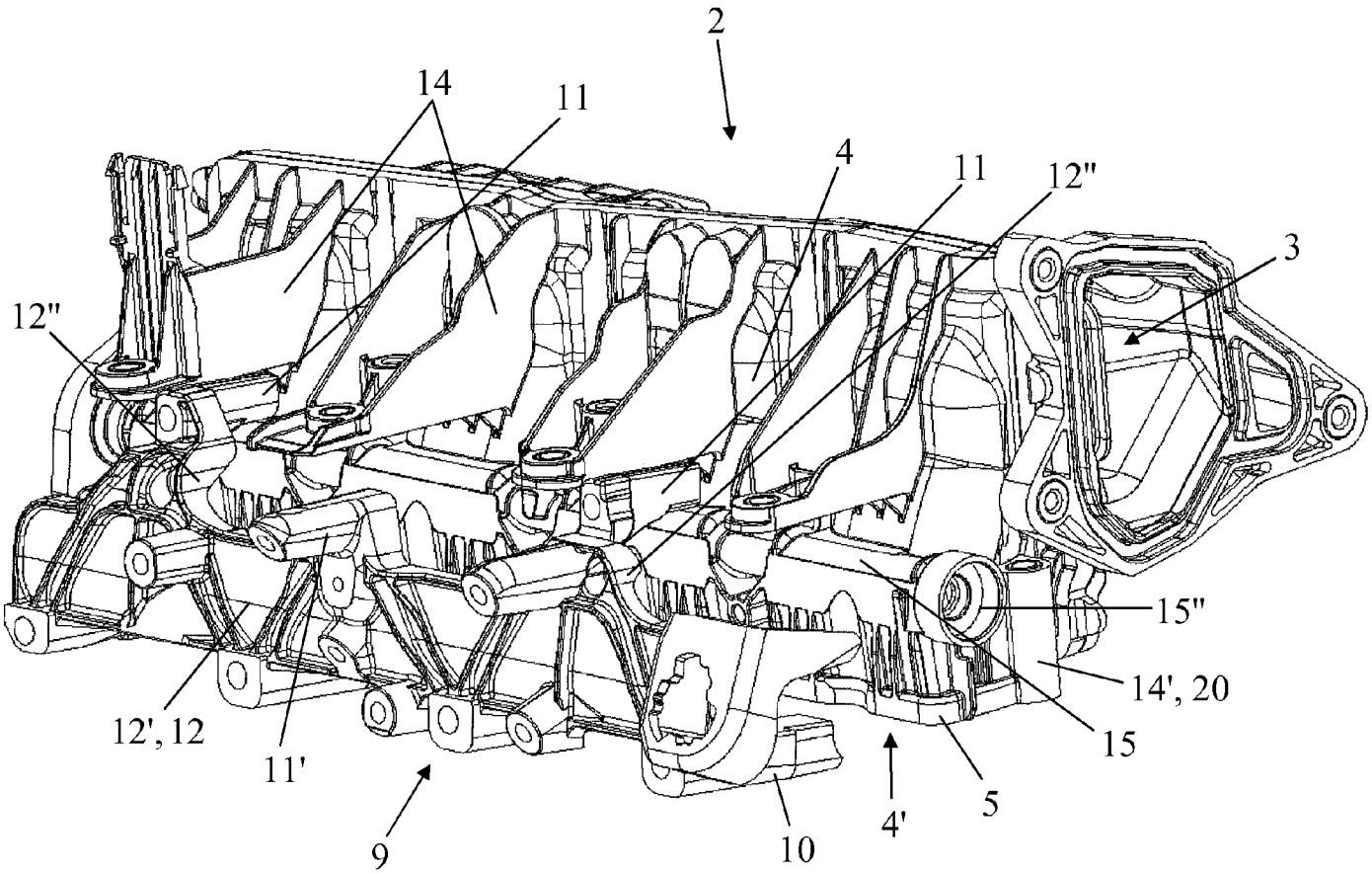
FIGS. 2B and 2C are perspective views that illustrate two stages of the assembly of the holding part with the inlet distributor that makes it possible to end, after the fuel rail is mounted, with a module as shown in FIGS. 1A and 1B.
Figure 2C:
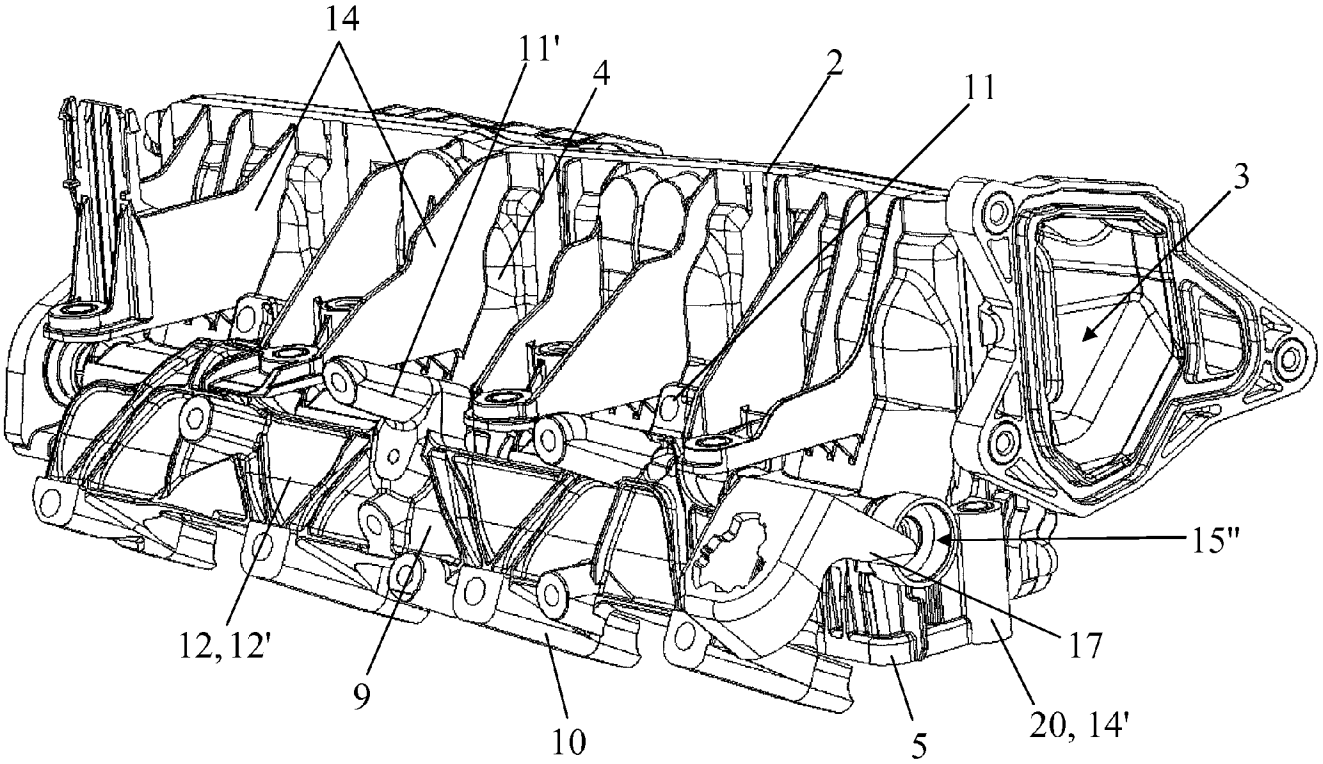
Figure 13:
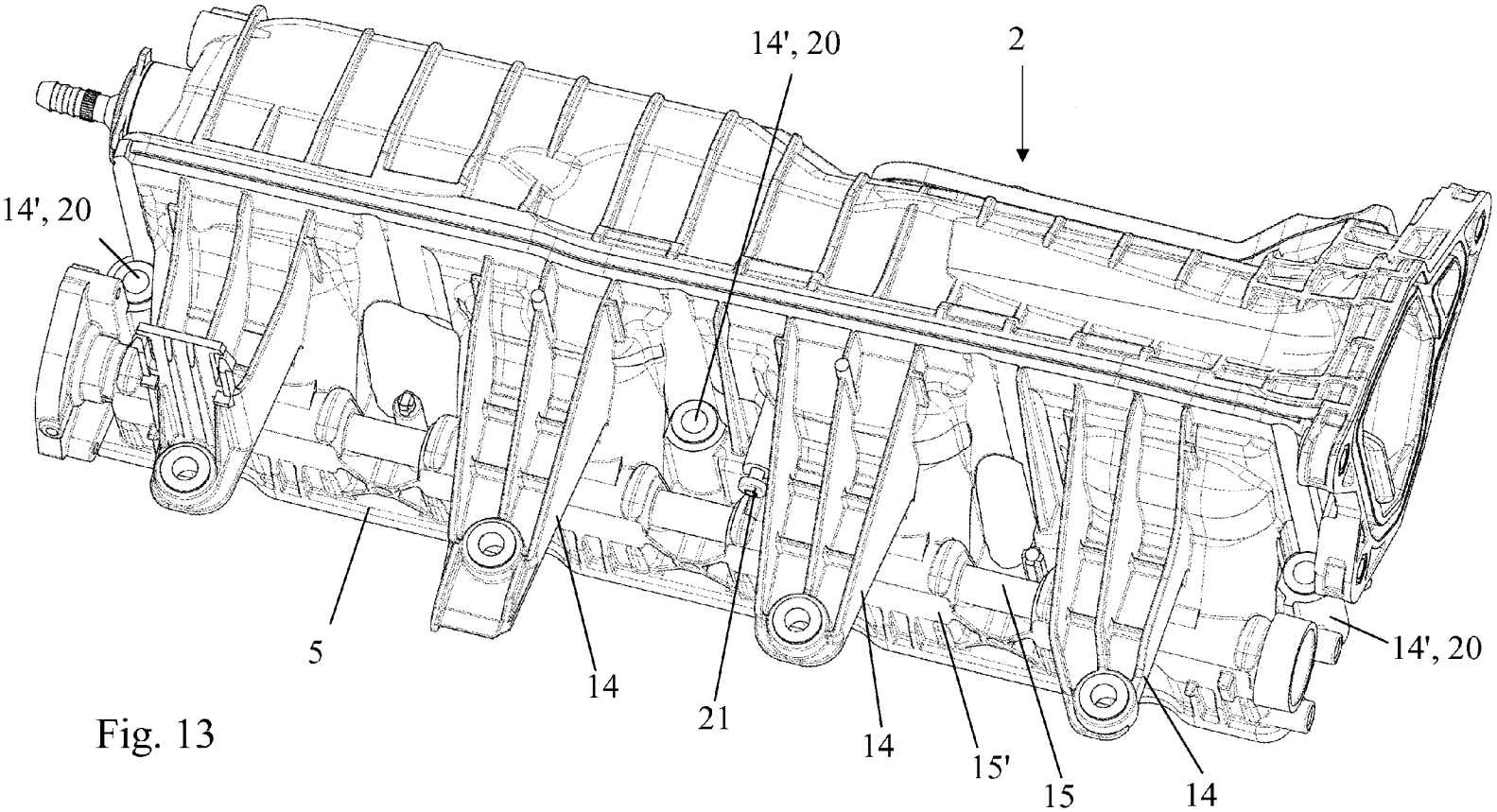
FIG. 13 is a perspective view of the inlet distributor that is part of the module shown in FIGS. 12A and 12B.
Figure 14:
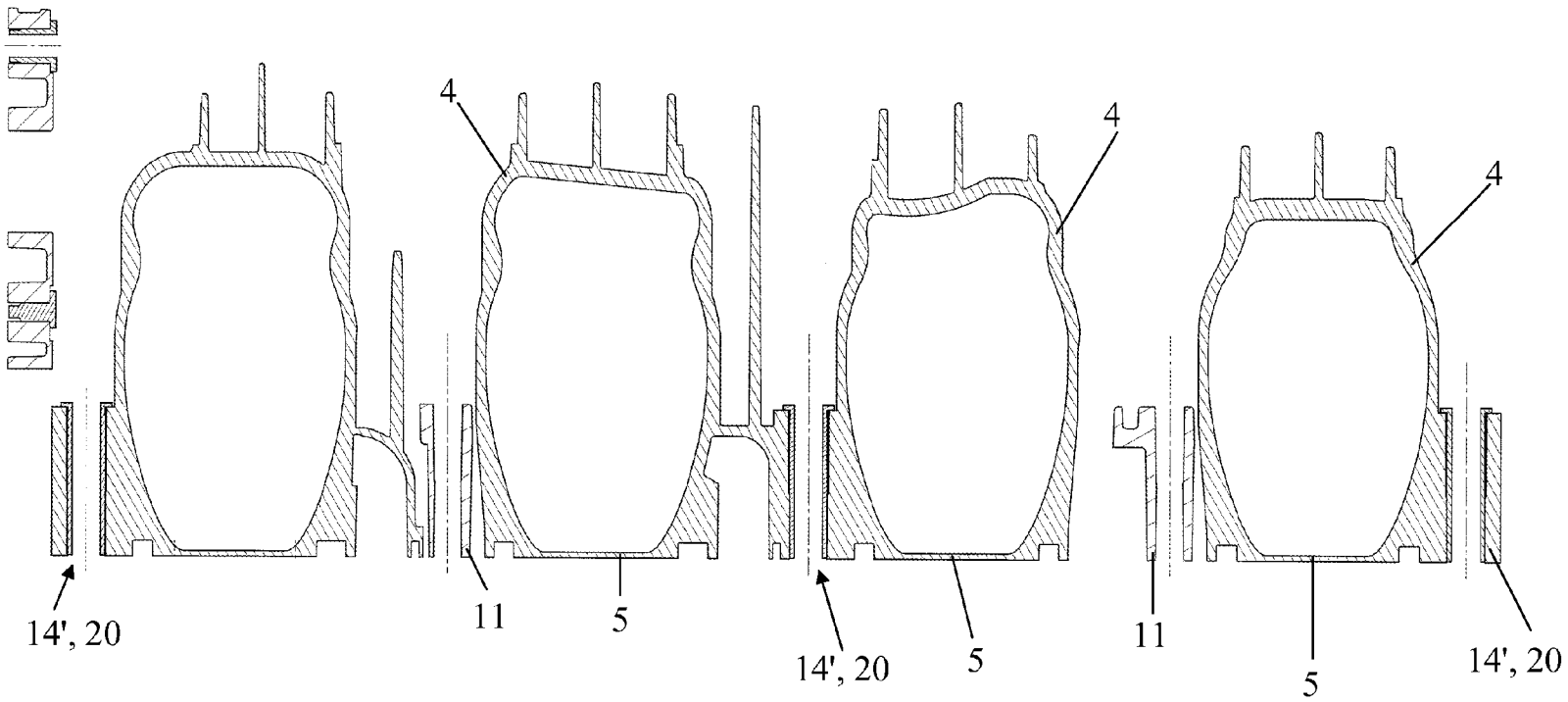
FIG. 14 is a longitudinal cutaway view, along a plane that extends essentially parallel to the central axis of the pipe of the fuel rail, of the module that is shown in FIGS. 12A and 12B, with the cutting plane passing through the attachment points that are specific to the distributor.
Figure 15A:
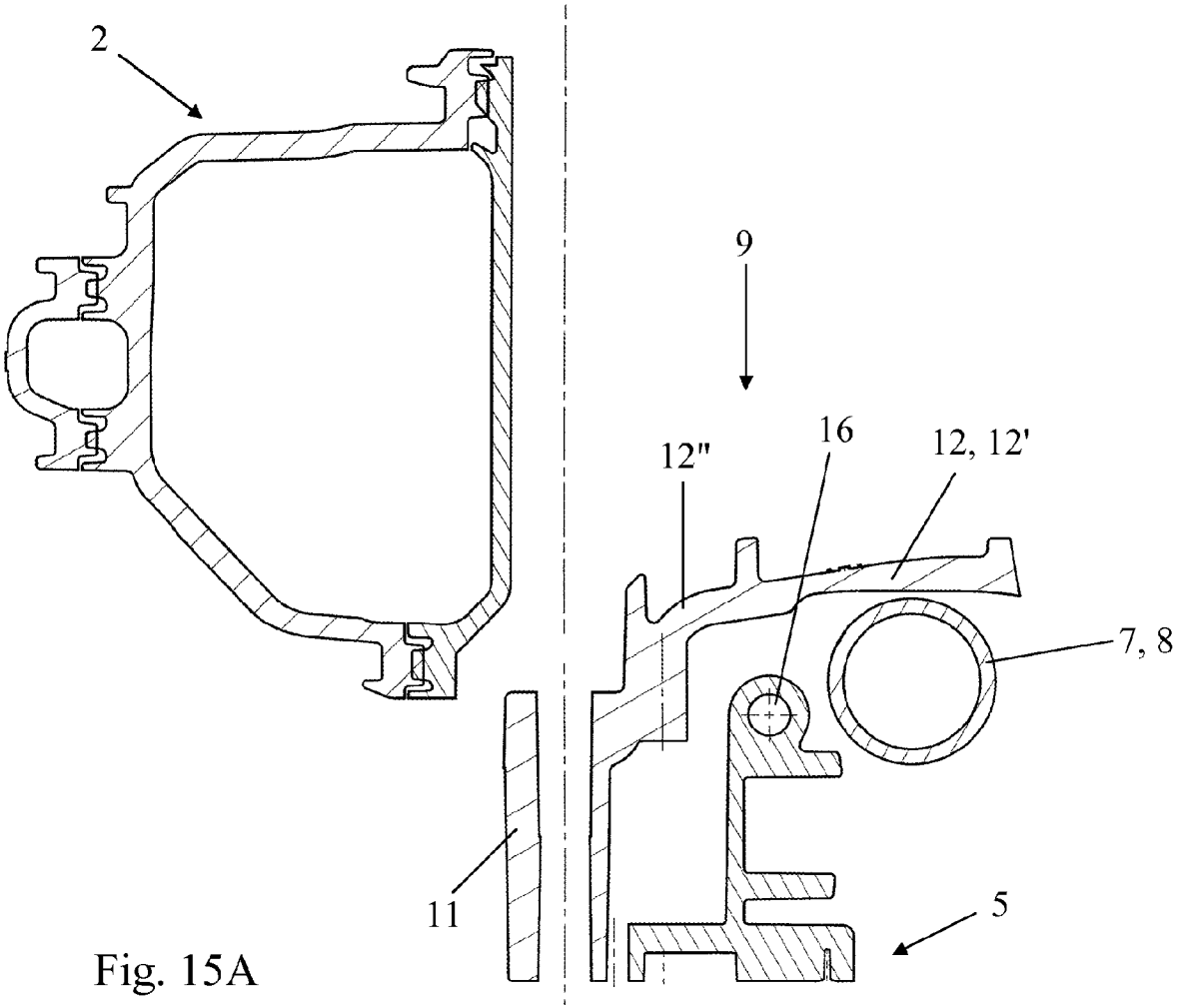
FIGS. 15A and 15B are transverse cutaway views, along a plane that is perpendicular to the cutting plane of FIG. 14, respectively at a support foot of the holding part (FIG. 15A) and at an attachment point that is specific to the distributor (FIG. 15B), before mounting injections (fuel rail not yet stressed toward the bottom of the longitudinal receiving housing).
Figure 15B:
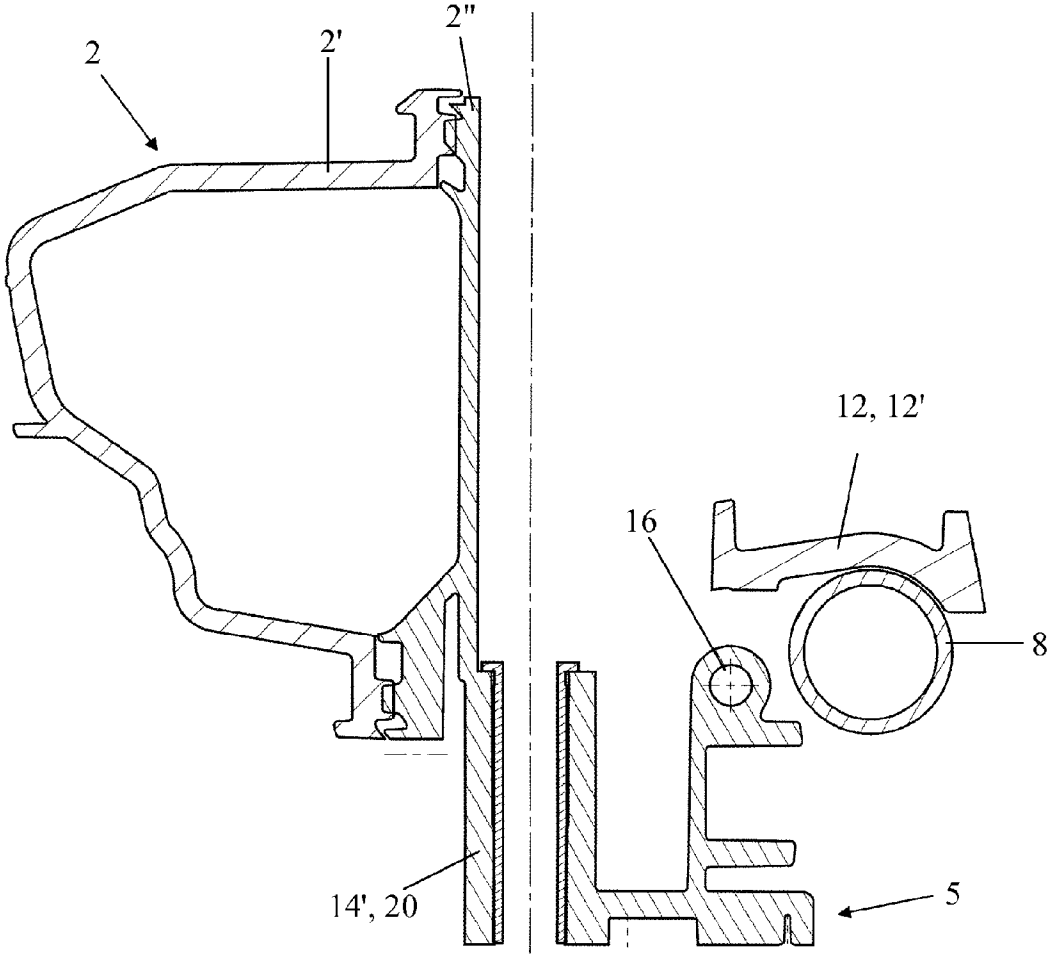

In accordance with a practical variant embodiment of the invention, the upper additional attachment feet 14 of the distributor 2 that line up with the first group of feet 10 of the holding part 9 are formed on the walls of the pipes 4, in the form of projections or protuberances of material integral with these walls (FIGS. 2 and 13 in particular).

The result is thus a partial sharing of the attachment points between part 9 and distributor 2 allowing a multiplication of anchoring sites for each of these components, without producing too significant a multiplication of all of the attachment sites.

So as to provide additional attachment points that are specific to the distributor 2, the latter can also be equipped with attachment feet or eyelets 14' located at the attachment and connection plate 5 and formed integral with it, whereby these feet or eyelets 14' correspond, at least for some, preferably for all, to the attachment points 20 that are separate from the attachment points of the support and attachment feet 10 and 11 of the holding part 9 (FIGS. 2A, 3, 9A, 13, 14 and 15B, in particular).

Likewise, the holding part 9 can also comprise specific and separate attachment points in the form of support and attachment feet 11 of the second group (FIGS. 1B, 7A, 9A, 11, 14, and 15A in particular).

Finally, the distributor 2 can optionally comprise at least one other attachment eyelet 14' that is part of, for example, the plate 5, and with which a foot lines up with an eyelet 11' that terminates a lateral projection 12" from the body in the shape of a wing 12' of the holding part 9.

This attachment eyelet 14' and this part 11' can be connected by a screw that ensures the locking of the assembly between part 9 and distributor 2.

Thus, the part 9/manifold 2 assembly can be locked even before its mounting on the engine block, and the connection between eyelets 11' and 14 contributes to the stiffening of the structure of the composite module, without being anchored in the cylinder head block (does not participate in the attachment to the engine block).

In accordance with an advantageous structural shape, shown in particular by FIGS. 1A, 4F, 5, 6, 7A, 7B, 8B and 9B of the drawings, the longitudinal receiving housing 13 with locking of the fuel rail 7 has—in cross-section—an oblong shape with, on the one hand, an introduction opening 13' that is located between the bases of the feet 10 of the first group, preferably forming an aligned arrangement, and the lower surface of the common plate 5, and, on the other hand, an intermediate part that houses the injectors and/or that is used as a guide zone for the fuel rail 7 during its mounting in the module 1, delimited by said feet 10 of the first group and the ends of pipes 4 adjacent to the plate 5, and, finally, a bottom housing location for receiving with wedging the fuel rail 7, where said location is defined by cooperation of an inside impression 12'" of the wing-shaped body 12' of the holding part 9 that extends laterally at the support and attachment feet 10 of the first group and portions of wall 15' of the ends of the pipes 4 that are close to the attachment and connection plate 5.

In accordance with an advantageous structural characteristic, the portions of wall 15' of different pipes 4 that form concordant lateral support zones for the fuel rail 7 in its locked state in the receiving housing 13 correspond to wall portions of pipes 4 proximal to the plate 5, for example correspond to portions of wall 15' of the receiving housings of regulating elements 6 of said pipes that are integral parts of a pipe formation 15 that receives the common control shaft 16 of the different elements for regulating the flows of different pipes 4, with the holding part 9 being equipped with a lateral flange 17 that locks the control shaft 16 in said pipe formation 15 at the opening 15" of the latter.

In accordance with a first embodiment, shown by FIGS. 1 to 7 and providing a mounting of the rail 7 after assembly of the distributor 2 and the part 9, the latter is, after assembly with interlocking and before attachment, advantageously movable in a limited manner relative to the distributor 2 in a direction that is perpendicular relative to the longitudinal direction of the receiving housing 13 of the fuel rail 7, thus making possible a modification of the width of said housing 13 between a value that allows the introduction and the extraction of said fuel rail 7 and a value that brings about a locking of the latter in said housing 13 in the mounted position of said rail 7.

Figure 4A:
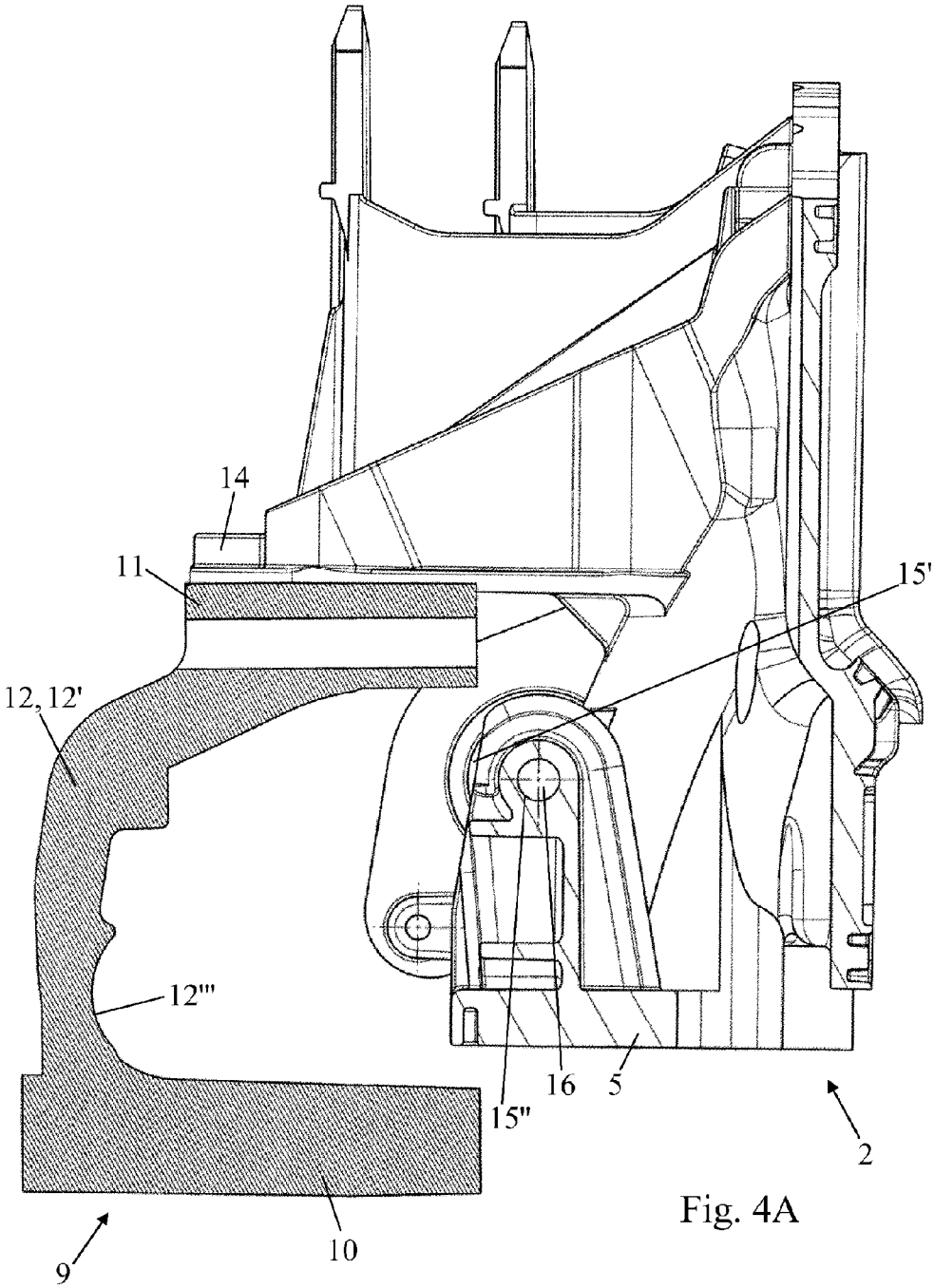
FIGS. 4A to 4F illustrate the successive stages of assembly by engagement with interlocking of the holding part with the distributor as shown in FIG. 3.
Figure 4B:
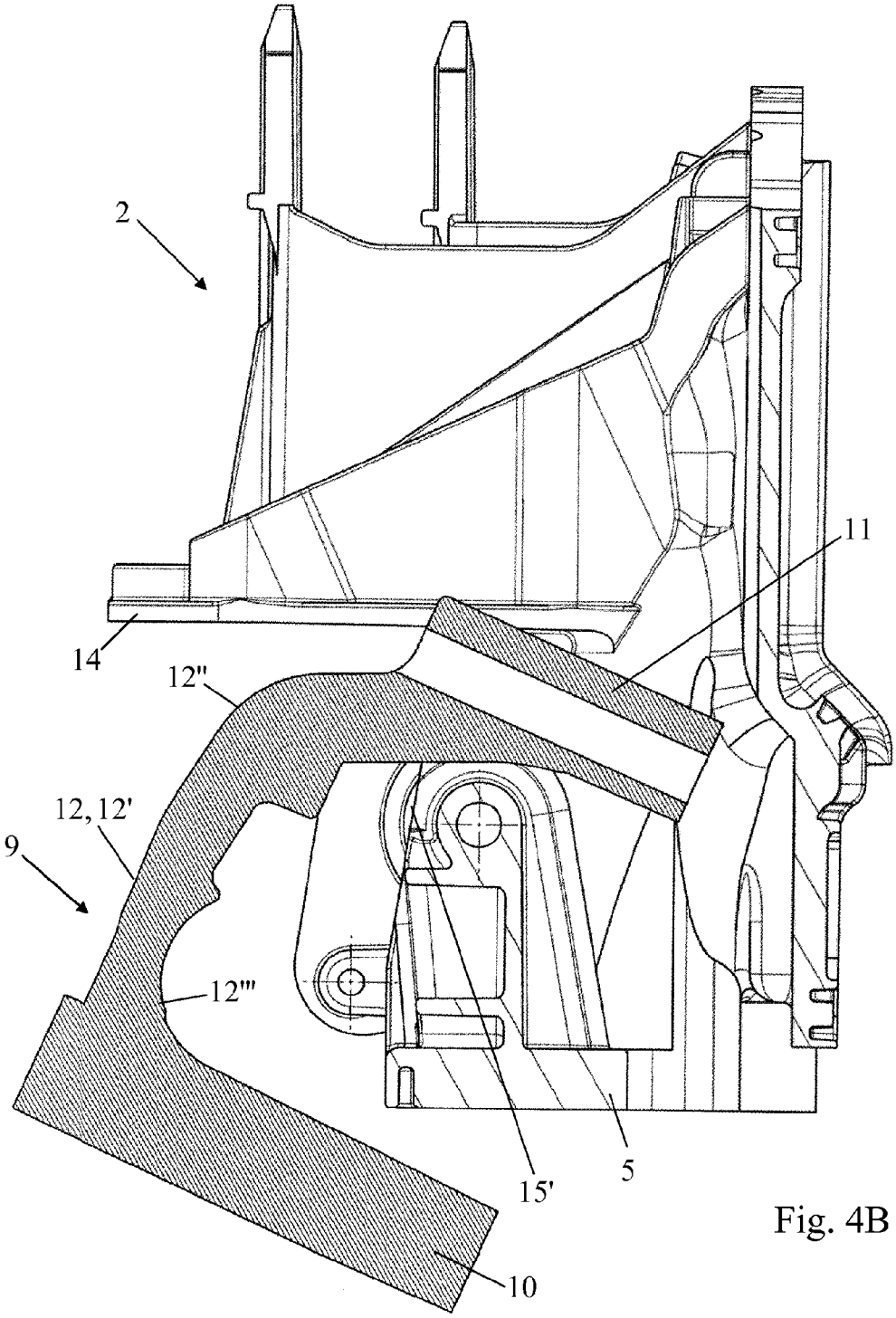
Figure 4C:
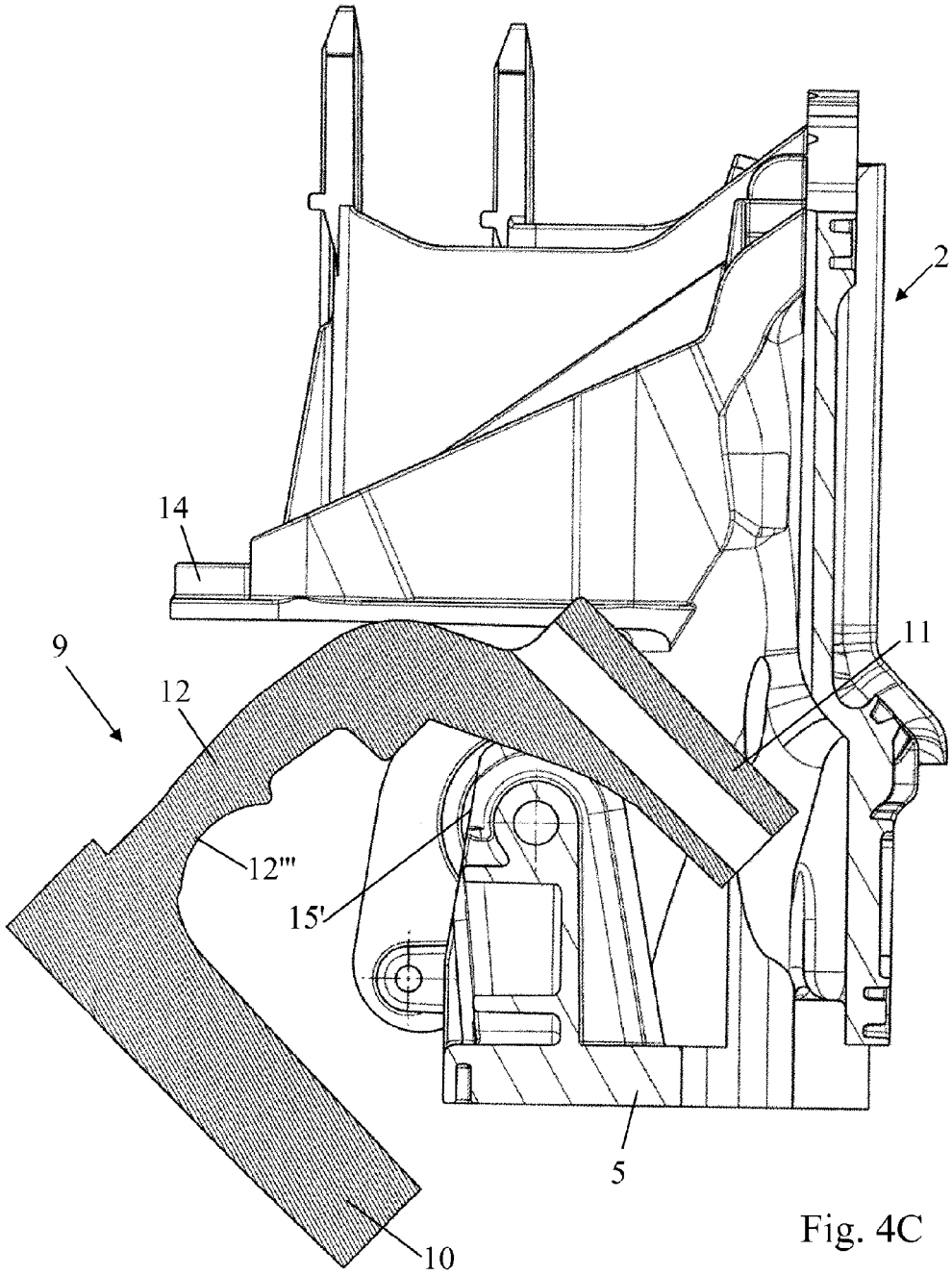
Figure 4D:
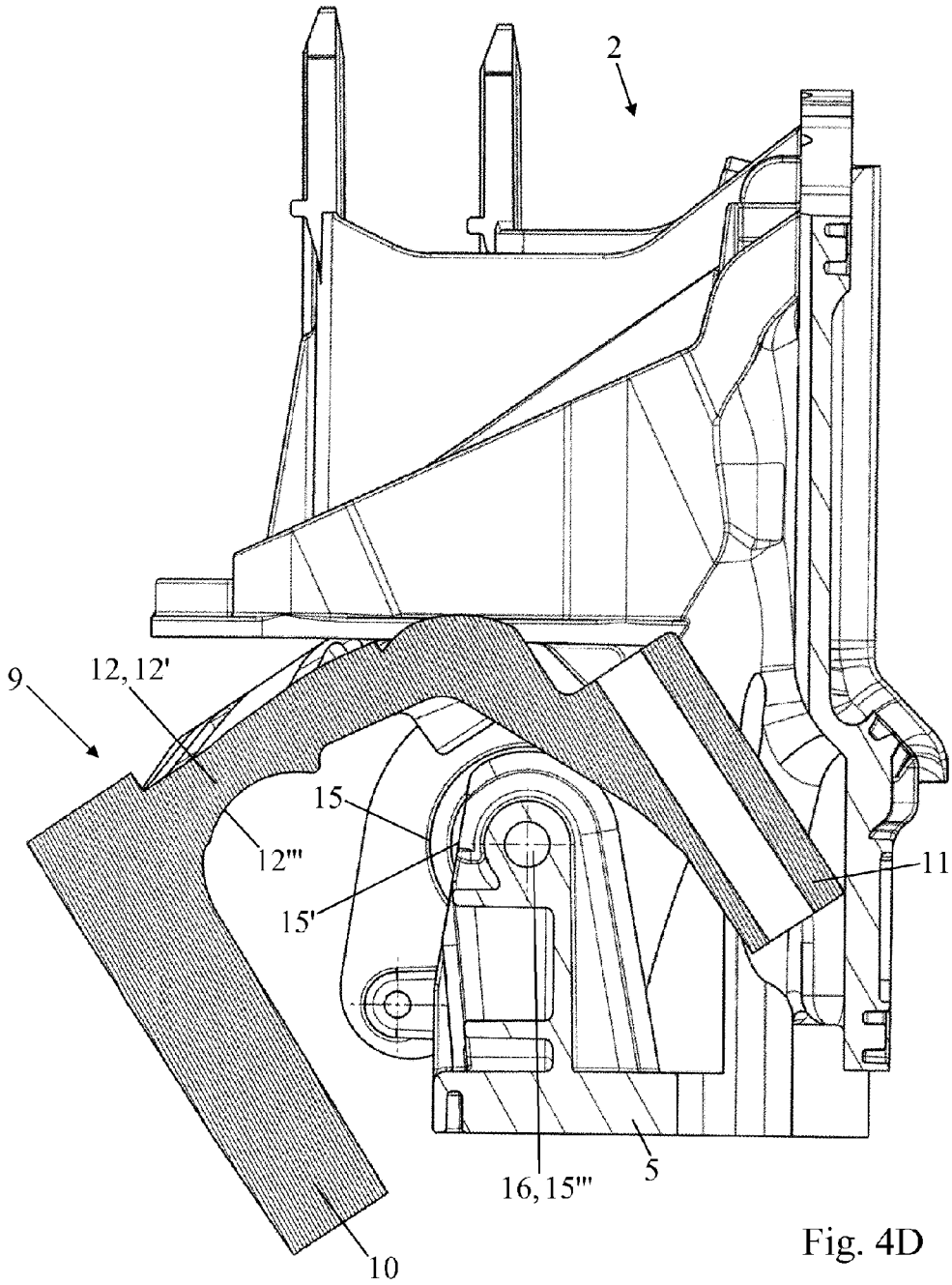
Figure 4E:
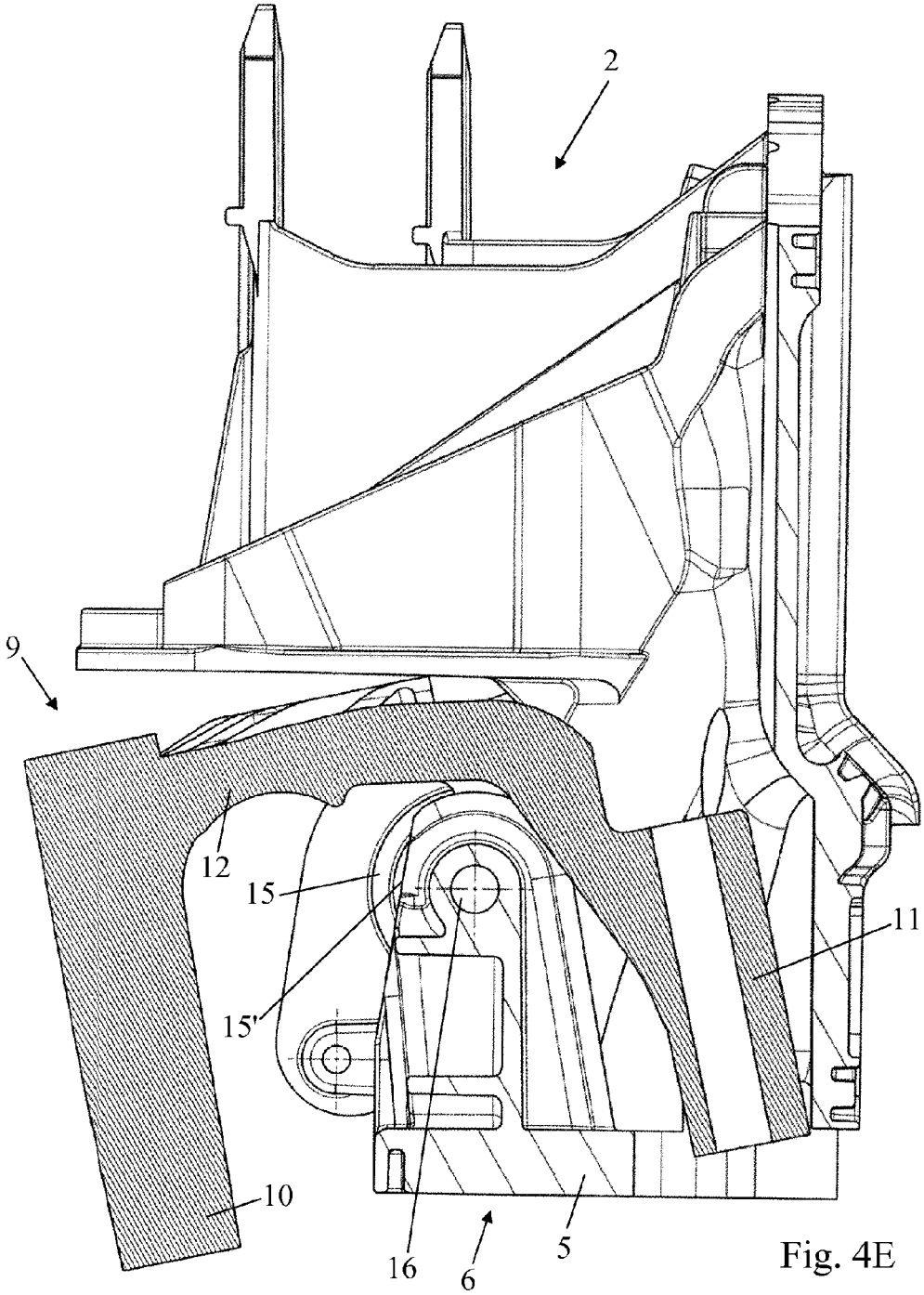
Figure 4F:
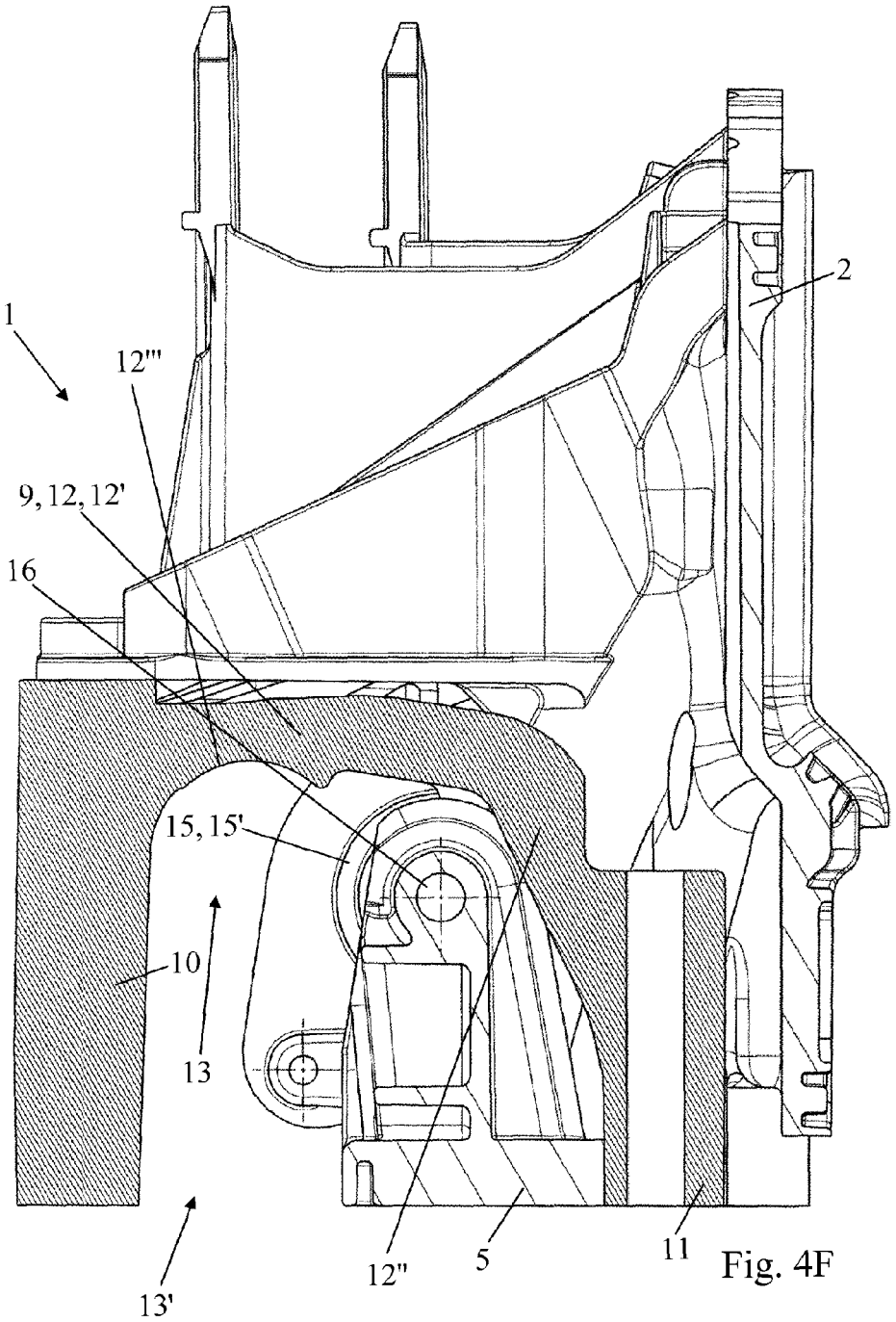
Figure 5:
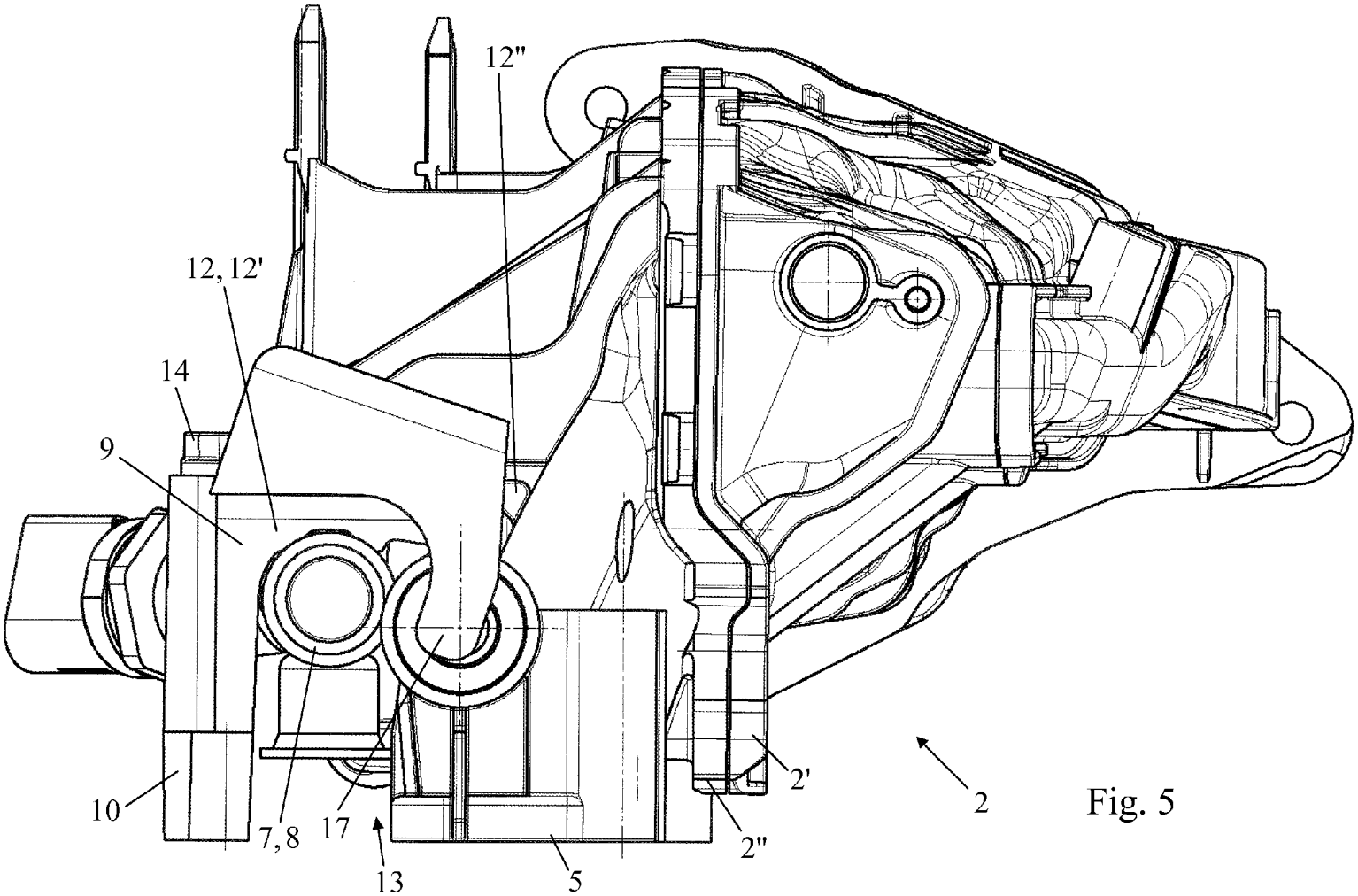
FIG. 5 is a lateral elevation view in a direction that is perpendicular to the cutting planes of FIG. 4 of the functional module after introduction of the fuel rail in its housing for receiving.
Figure 6:
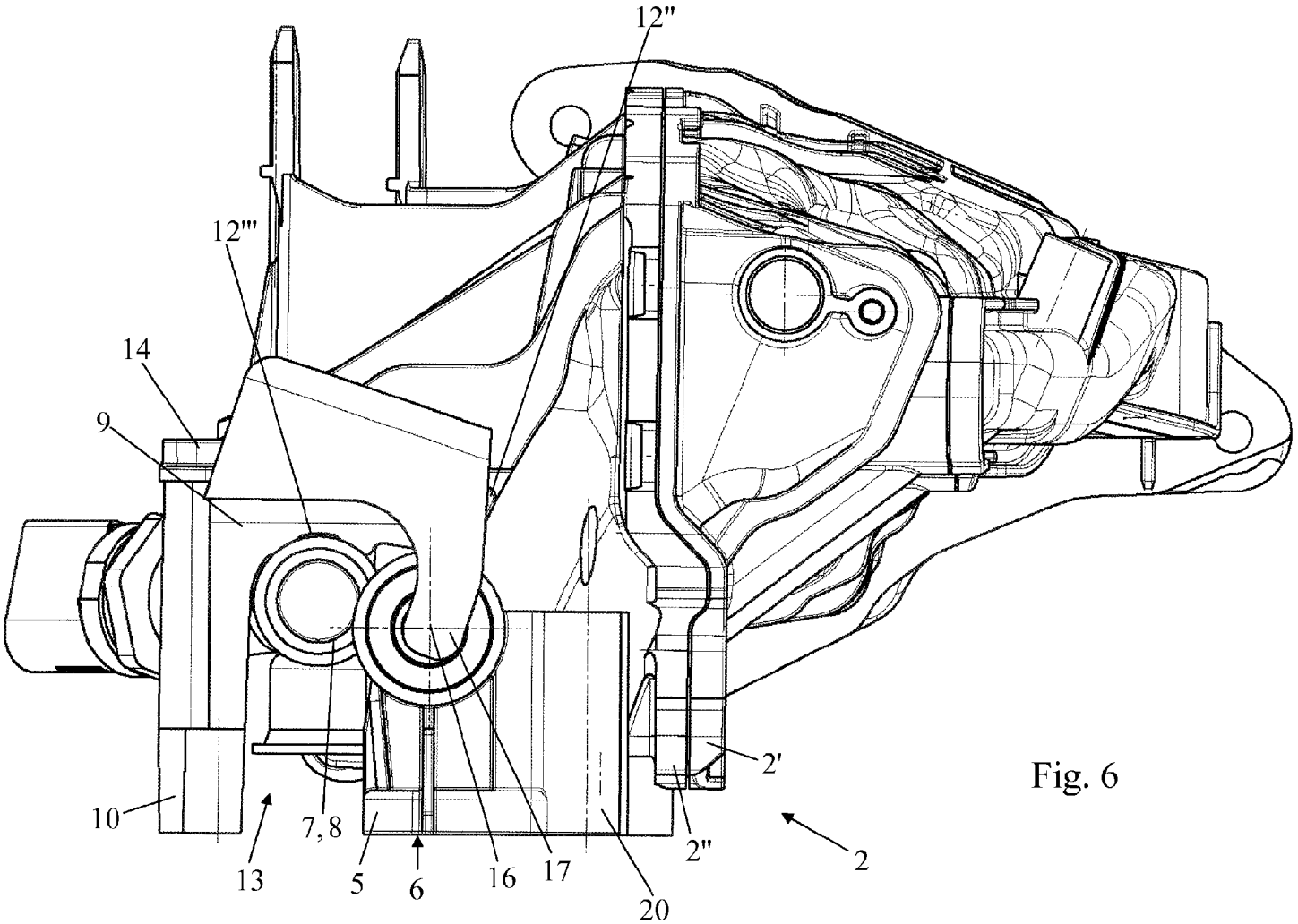
FIG. 6 is a view that is similar to FIG. 5, with the fuel rail being locked in position at the bottom of the receiving housing (difference relative to FIG. 5: lateral translational movement of the holding part relative to the distributor)
Figure 7A:
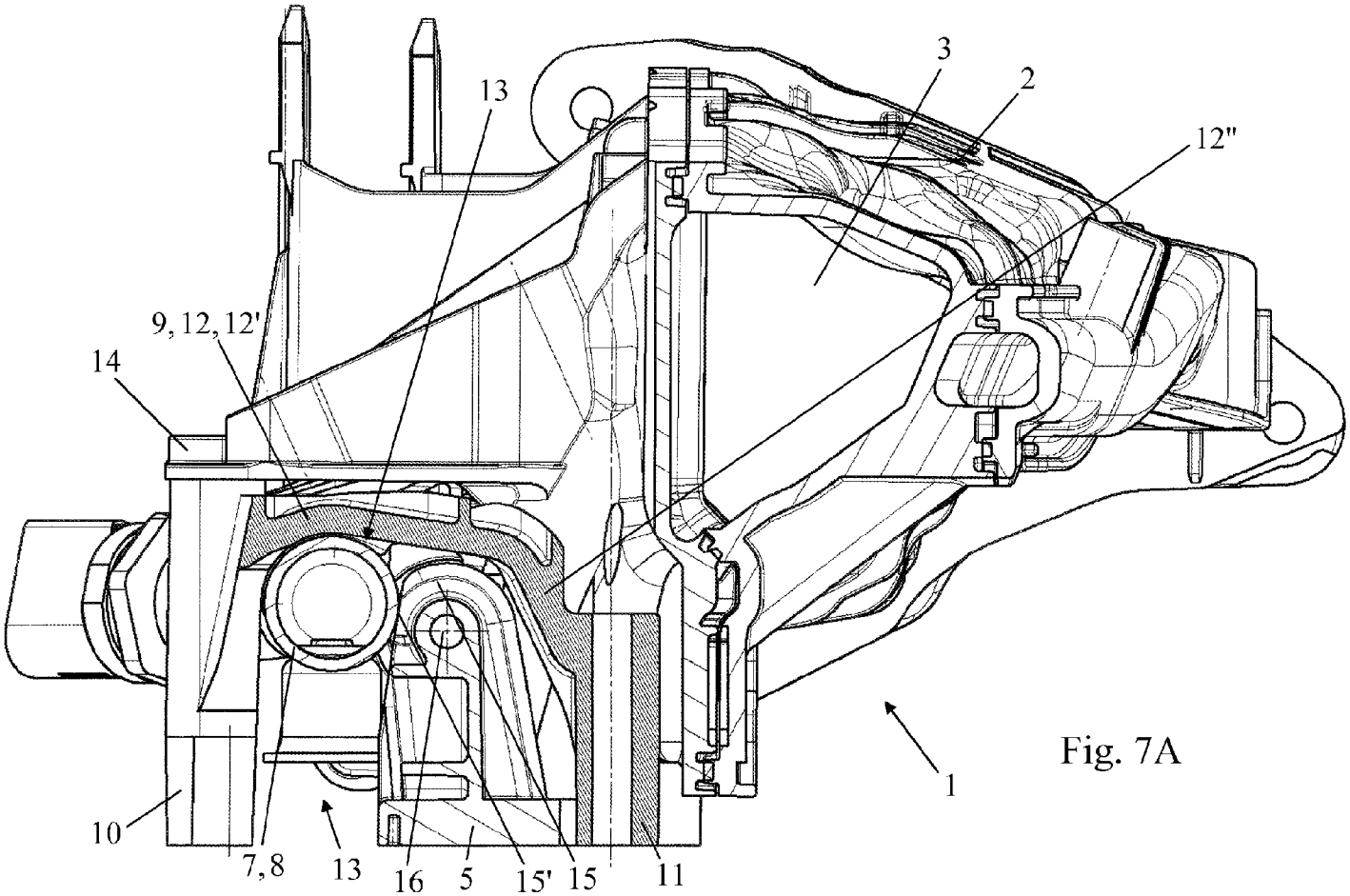
FIGS. 7A and 7B are transverse cutaway views of the functional module as shown in FIG. 6, respectively along a cutting plane that passes through a support and attachment foot of the second group of the holding part (FIG. 7A) and along a cutting plane that passes through the support and attachment foot of the first group of the holding part (FIG. 7B)

The limited relative movement that is allowed between the holding part 9 and the distributor 2, after assembly with interlocking of these two components, is shown in particular by a comparison of FIG. 4F with FIG. 7A and a comparison of FIG. 5 with FIG. 6.

Figure 7B:
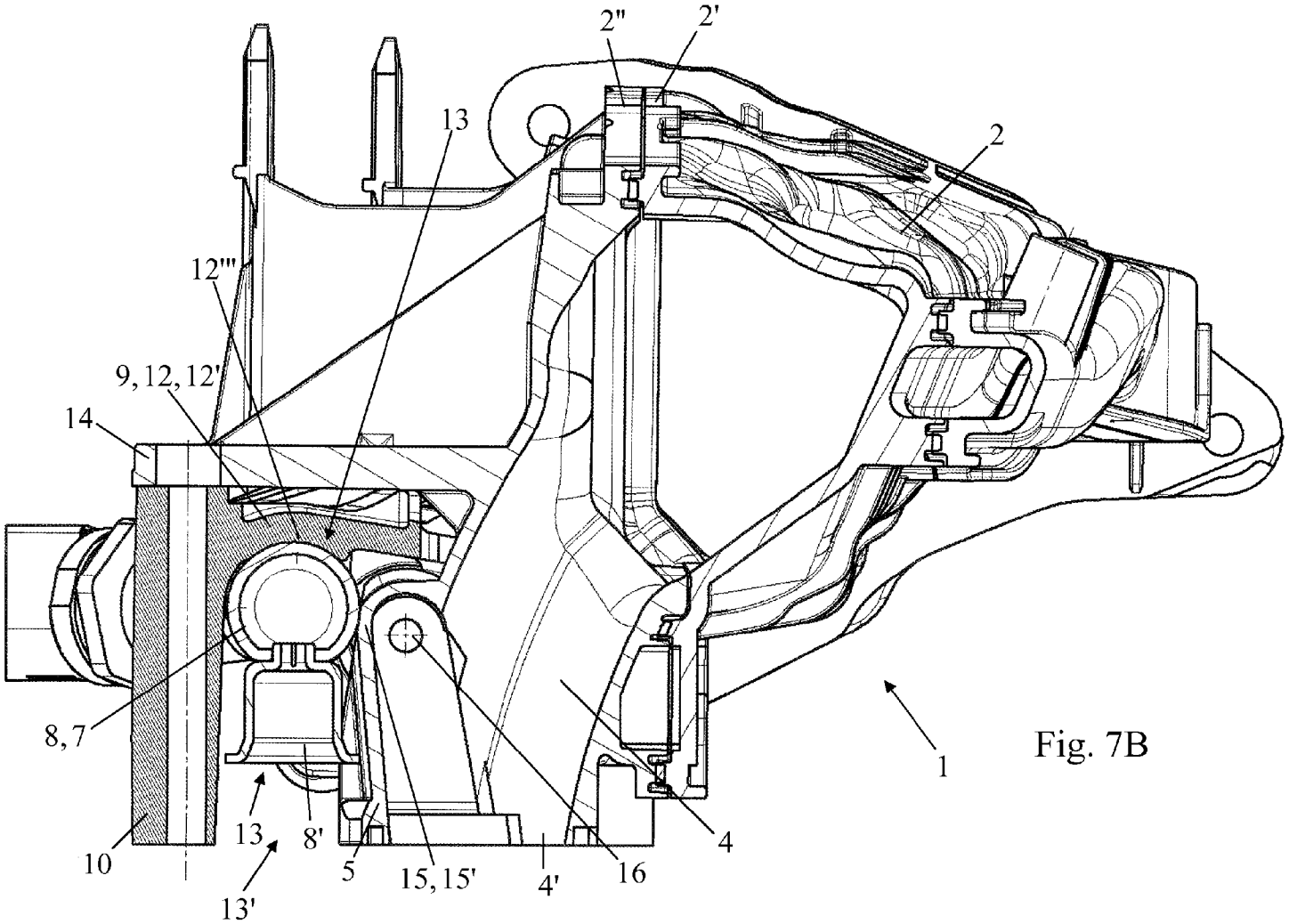

When the holding part 9 is moved into the position that is shown by FIGS. 6, 7A and 7B, the fuel rail 7 is flattened by the feet 10 and the bridge of material 12 against the portions of walls 15', thus ending in a locking in position of said rail 9 at the bottom of the housing 13.

This locked positioning of the rail 7 can advantageously be exploited to accomplish manipulation and transport of the entirely preassembled functional module 1 (distributor 2, holding part 9, fuel rail 7), without the risk of losing the rail 7.

Figure 12A:
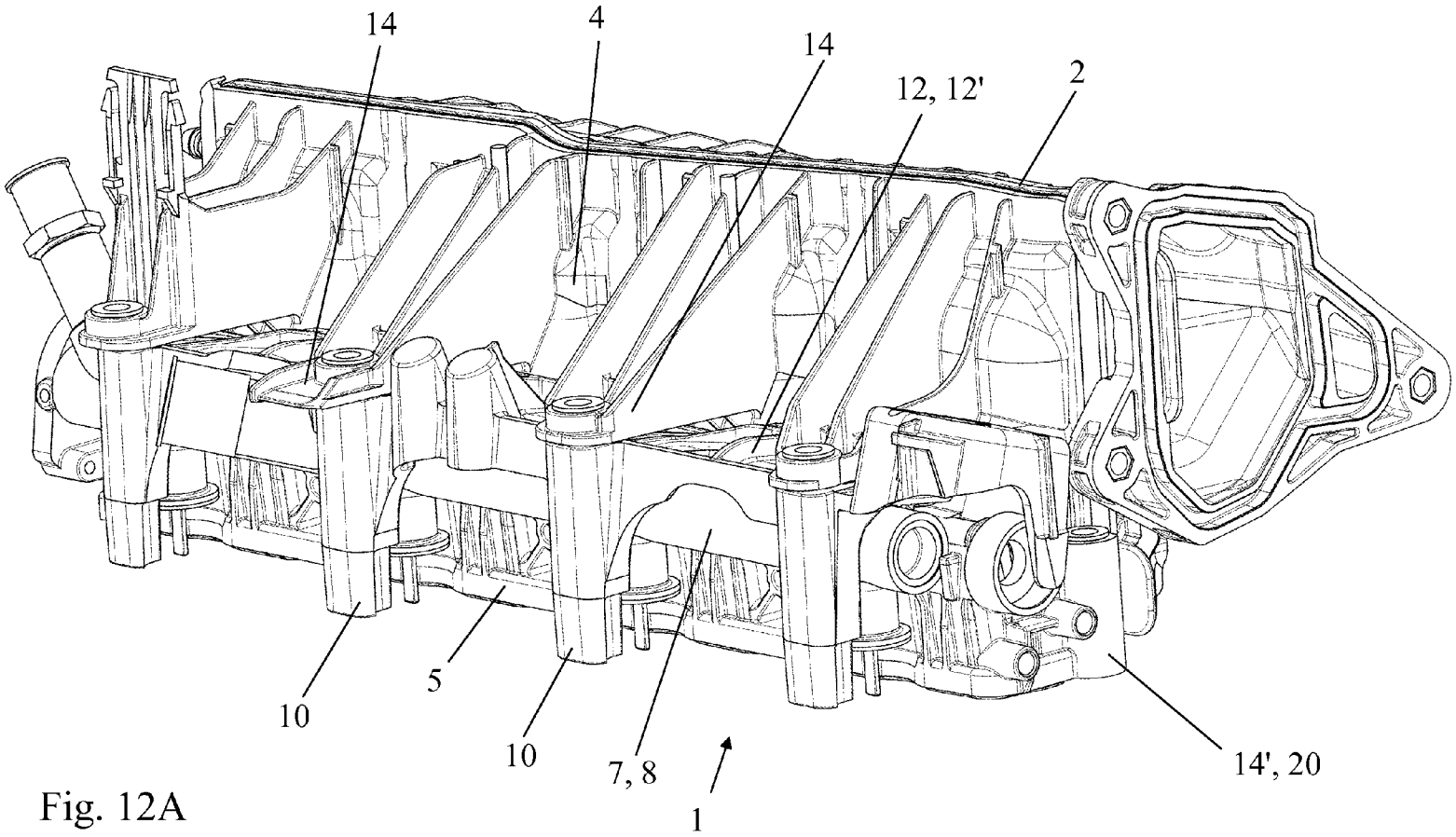
FIGS. 12A and 12B are perspective views along two different angles of a functional module that is essentially similar to that of FIGS. 1A and 1B and that only notes minor structural differences in the shape of certain constituent parts.
Figure 12B:
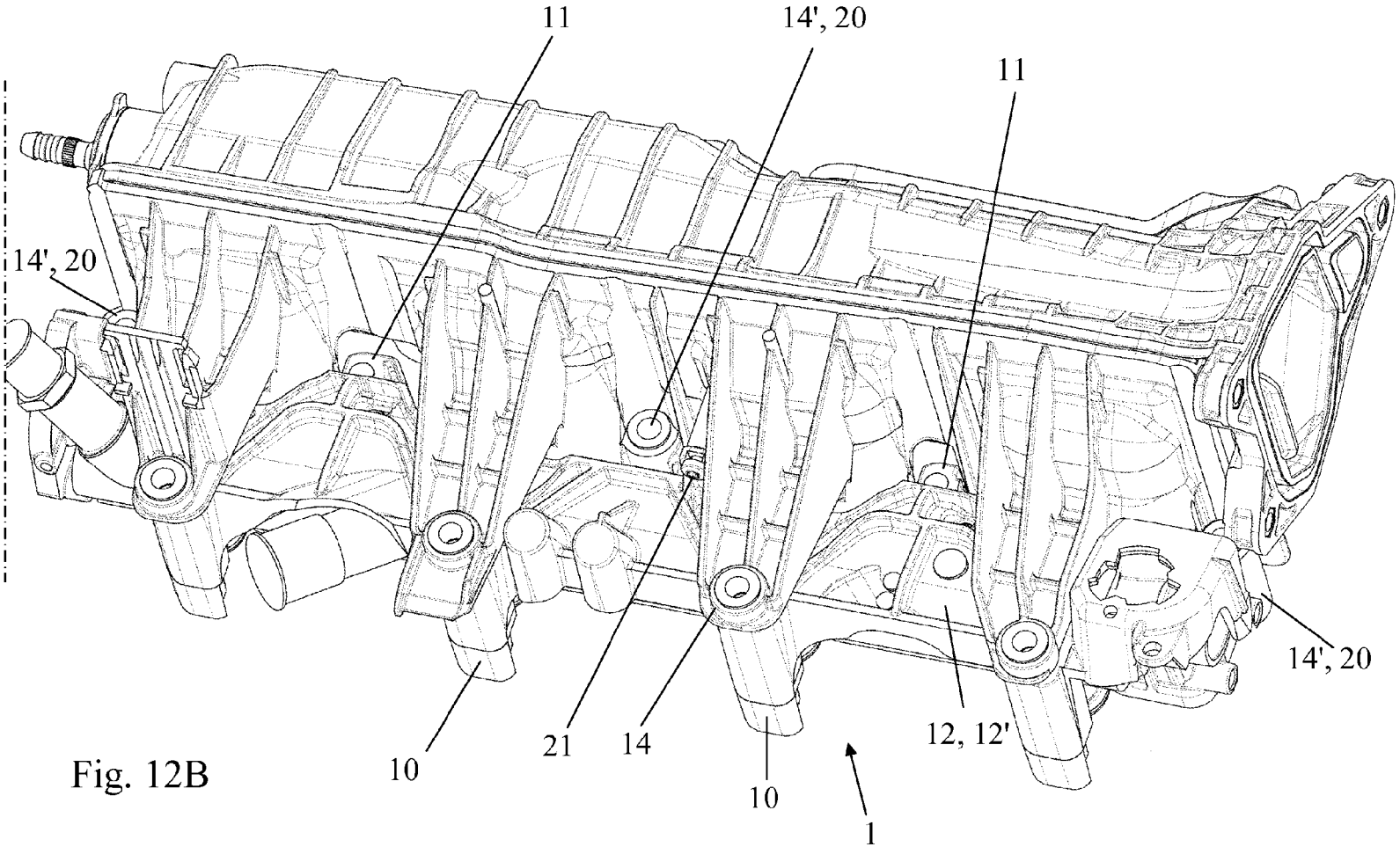

The above-mentioned preassembly of the module 1 can optionally be locked by one or more temporary fastening screws 21 that connect the holding part 9 to the distributor 2 during the phases for manipulation and transport of this module (FIGS. 12B and 13).

During the mounting of the module 1 on the engine block, a new relative movement of the part 9 relative to the distributor 2 (optionally after removal of the temporary fastening screws) will make it possible to put the module 1 into its mounting and attachment configuration, with the fuel rail 9 then normally no longer being in contact with the portions of wall 15', but only offset with locking in the impression 12'" of the bridge of material 12 under the action of the springs of the injectors.

According to a preferred method for producing constituent components of the functional module 1 according to the invention, the holding part 9 is made of a single piece of a molded material, and the inlet distributor 2 consists of at least two complementary parts 2' and 2" made of molded material and assembled by vibration welding, gluing, or screwing, at complementary peripheral pointing zones.

Figure 8A:
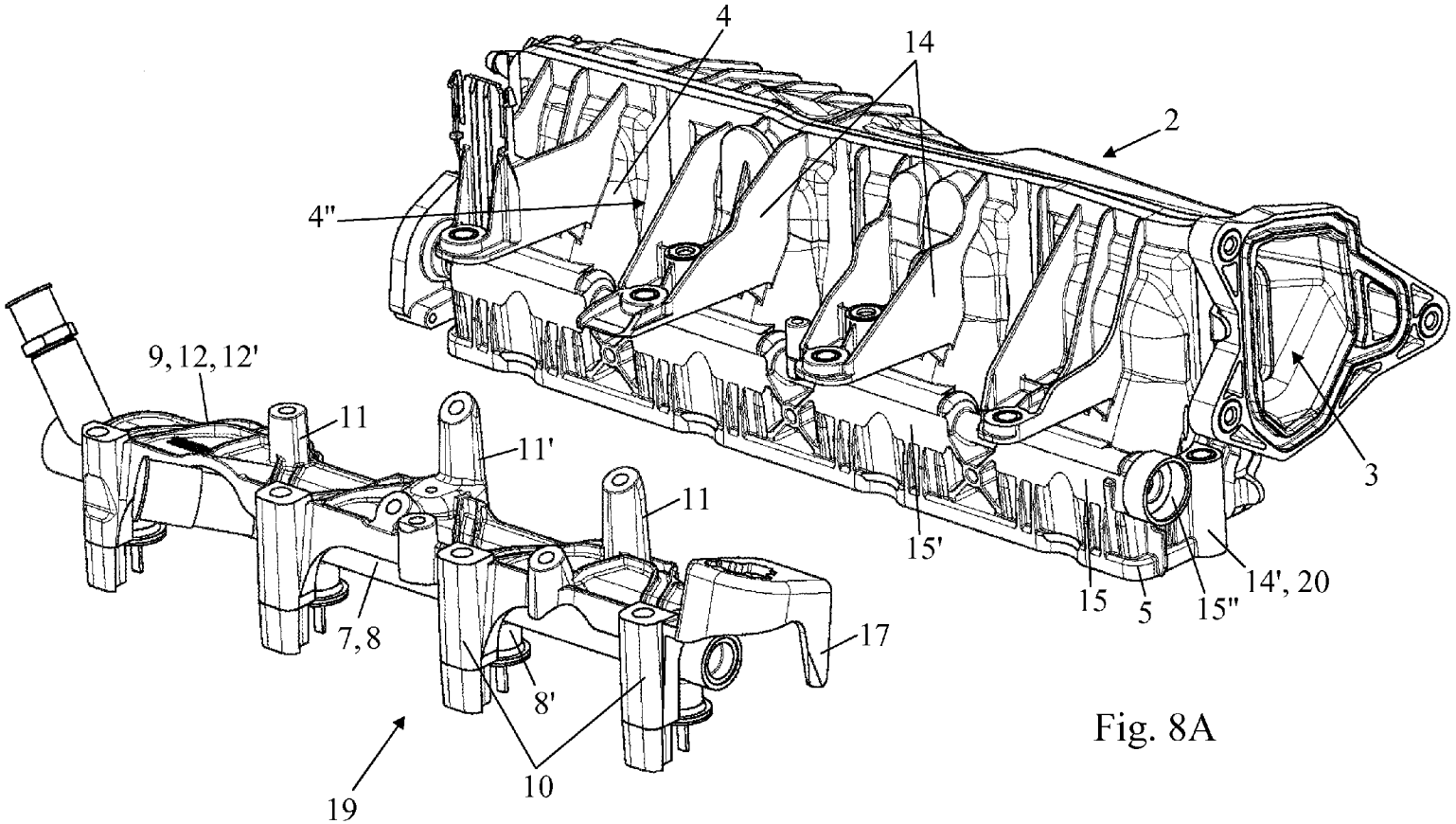
FIGS. 8A and 8B are views that illustrate a second embodiment of the functional module according to the invention, respectively an exploded perspective view before assembly of the module (FIG. 8A) and a transverse cutaway view along a cutting plane that passes through a support and attachment foot of the first group of the holding part (FIG. 8B), after assembly of the module.
Figure 8B:
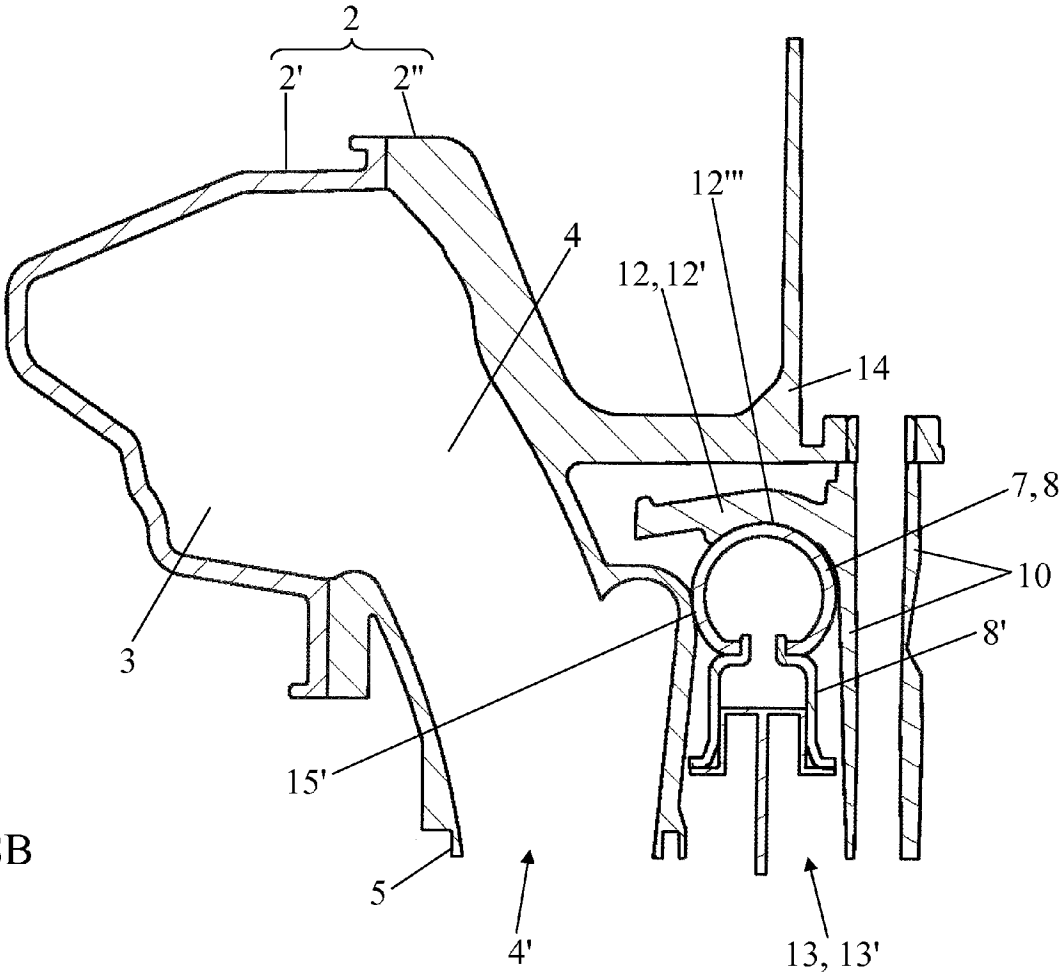

In accordance with a second embodiment, shown by FIGS. 8A and 8B, the wing-shaped body 12' of the holding part 9 comprises an inside impression 12'" that forms—by cooperation with the ends of the support and attachment feet 10 of the first group that are contiguous to the bridge of material 12—a receiving site with locking for the fuel rail 7, making it possible to produce a structural unit by mechanical assembly of the holding part 9 and the fuel rail 7.

In this case, the holding part 9 can in particular be made of a metal, thermoplastic or Thermodur material.

As FIG. 8B shows it, the fuel rail 7 is, after assembly of the premounted unit 19 with the distributor 2, in lateral support against portions of wall 15' that are part of the pipes 4, for example portions of wall of the housings for receiving regulating elements 6 (not shown) of said pipes.

Said rail 7 is thus locked positively and mechanically in the receiving site formed by the impression 12'" and the feet 10, that holds it just by pivoting action alone, for example.

In accordance with a third embodiment that is shown by FIGS. 9A and 9B, the holding part 9 and the fuel rail 7 are assembled by welding or brazing, in a structural unit, with the fuel rail 7 and at least partially the holding part 9 being made of a metal material.

In this embodiment, the fuel rail 7 can also, as FIG. 9B shows, be locked in position in an additional manner by lateral support of its housings 8' for receiving injectors against the portions of wall 15' of the pipes or the attachment and connection plate 5.

The inlet distributor 2 can advantageously be of the type of the one that is described and shown in the French Patent Application No. 09 56042 filed on Sep. 4, 2009 in the name of the applicant, i.e., by integrating into the circuit for evacuating gases from the crankcase.

As at least FIGS. 10 and 11 show, and in accordance with another structural variant embodiment of module 1 according to the invention, the attachment and connection plate 5 can consist of a separate part, preferably obtained by injection molding of a thermoplastic material, integrating at least the ends of the pipes 4 and assembled in an airtight manner with the body of the distributor 2, with the latter optionally being equipped with complementary portions of said pipes 4, and, if necessary, consisting of at least two complementary parts 2' and 2" made of molded material that are assembled by, for example, welding (by vibration), gluing, over-molding or screwing, at complementary peripheral pointing zones (the distributor 2 then consists of the assembly of at least three parts).

This invention also relates to a vehicle with an internal combustion engine that is supplied by a fuel rail 7, characterized in that it comprises a functional module 1 as described above.

The invention also relates to a process for the production of a functional module 1 as described above.

According to a first embodiment of the invention and as FIGS. 1 to 7 of the accompanying drawings show, this process consists primarily in producing separately, on the one hand, an intake manifold or an inlet distributor 2, and, on the other hand, a fuel rail 7, and, finally, a holding part 9, to assemble the holding part 9 with the distributor 2 by introducing each of the support and attachment feet 11 of the second group into a corresponding space or passage that is released between two pipes 4 in a pivoting movement in such a way as to end in an interlocking of said feet 11 and their respective adjacent projections 12" between the pipes 4 in question and in the formation of a longitudinal housing 13 with an oblong cross-section for receiving the fuel rail 7 between the support and attachment feet 10 of the first group, a portion 15' of the common lateral wall of the ends of the pipes 4 and their attachment and connection plate 5 and a wing-shaped body 12' of the holding part 9, to introduce the fuel rail 7 at the bottom of said longitudinal housing 13, with the latter having a width that is greater than the diameter of said rail 7, and, finally, to move the holding part 9 and the distributor 2 relative to one another to reduce the width of the longitudinal housing 13 and thus to lock the fuel rail 7 at the bottom of the housing 13.

In accordance with a second embodiment of the invention, shown by FIGS. 8, 9 and 11 of the drawings, the process can essentially consist in producing separately, on the one hand, an inlet distributor 2 or a plate 5 of pipes, and, on the other hand, a fuel rail 7, and, finally, a holding part 9, in forming a premounted unit 19 by assembly of the fuel rail 7 with the holding part 9, in assembling the premounted unit 19 with the distributor 2 or the plate 5 by introducing each of the support and attachment feet 11 of the second group into a corresponding space or passage 4" that is released between two pipes 4 in a pivoting movement in such a way as to end in an interlocking with locking of said feet 11 and their respective adjacent projections 12" between the pipes 4 in question and in the formation of a longitudinal housing 13 with an oblong cross-section for receiving the fuel rail 7 between the support and attachment feet 10 of the first group, with a portion 15' of the common lateral wall of the ends of the pipes 4 and their attachment and connection plate 5 and a wing-shaped body 12' of the holding part 9.

In accordance with a first variant, and as FIGS. 8A and 8B show, the production of the premounted unit 19 consists in mechanically assembling by interlocking the fuel rail 7 with the holding part 9 at a receiving site with locking of the latter.

In accordance with a second variant, and as FIGS. 9A and 9B show, the production of the premounted unit 19 consists in assembling by welding or brazing the fuel rail 7 with the holding part 9 at the wing-shaped body 12' of the latter.

According to one characteristic of the invention, this process also consists—prior to the assembly of the part 9 or the premounted unit 19 with the distributor 2 or the plate 5—in installing regulating elements, for example of the valve type, in the ends of the pipes 4 through the plate 5, and then in introducing the common control shaft 16 of said elements longitudinally into a pipe formation 15 that connects to one another and passes through the different pipes 4.

Preferably, the holding part 9 is formed by a single piece by molding, for example of thermoplastic or metal material, and the distributor 2 is formed by assembling at least two parts 2' and 2", for example by welding, gluing, etc., with each of said parts being made in a single piece by injection molding of, for example, thermoplastic material.

When the plate 5 with the ends of the pipes 4 forms a separate part of the body of the distributor 2 (FIGS. 10 and 11), the unit (plate 5—rail 7—part 9) is first preassembled, and then the body of the distributor 2 is mounted in an airtight manner on said plate 5 by connecting at the pipes. The two variants of the production process mentioned above are compatible with such an embodiment of the distributor 2.

Of course, the invention is not limited to the embodiment described and shown in the accompanying drawings. Modifications are possible, in particular from the standpoint of the composition of the various elements or by substitution of equivalent techniques, without thereby exceeding the field of protection of the invention.

The invention claimed is:

1. A functional module that mounts on an engine block with cylinder heads, comprising:

an inlet distributor (2);

a mixing/distribution chamber (3) integrated within the intake manifold (2);

pipes (4) integrated within the inlet distributor (2) and extending laterally from said chamber, the pipes each having an outlet opening (4'), the outlet opening (4') of each pipe being physically connected to the outlet opening (4') of the other pipes;

a common attachment and connection plate (5) formed by the connected outlet openings (4'), the common attachment and connection plate (5), when attached to the engine block, being airtight to the cylinder heads;

a high-pressure fuel rail (7) in the form of a pipe (8) with plural lateral housings (8') for injectors;

a holding part (9) locking said fuel rail (7) in position with the fuel rail (7) being held between the holding part (9) and the inlet distributor (2), the holding part (9) comprising first and second groups of support and attachment feet (10, 11) each of the attachment feet having attachment points, wherein the holding part (9), when mounted to the engine block, rests directly on and is made integral with the engine block, with the first group (10) of support and attachment feet extending on a first side of the common attachment and connection plate (5) and the second group of support and attachment feet (11) extending on a second side of the common attachment and connection plate (5);

a bridge (12) that connects the support and attachment feet (10, 11) of the first and second groups of support and attachment feet to one another, the bridge (12) being part of the holding part (9); and a longitudinal receiving housing (13) extending over an entire length of the fuel rail, the receiving housing formed by cooperation of i) at least a portion of said bridge (12), ii) the first group of the support and attachment feet (10) forming an alignment at a distance from the common attachment and connection plate (5), and iii) a portion of a lateral wall of said common attachment and connection plate (5), the fuel rail (7) being received and locked in the receiving housing (13), wherein the inlet distributor (2) is equipped, i) at the common attachment and connection plate (5), with attachment sites (20) for attachment on the engine block, said attachment sites (20) being separate from the attachment points of the first and second groups of support and attachment feet (10, 11), and ii) upper attachment feet (14) that extend a distance from the common attachment and connection plate (5) and line up with and come to rest on the first group of support and attachment feet (10) when, in an assembled state of the functional module (1) being mounted to the engine block, the fuel rail (7) not participating in the attachment of the inlet distributor (2) to the engine block.

2. The functional module according to claim 1, wherein the bridge (12) comprises a wing-shaped body (12') with an essentially continuous structure, laterally adjacent to the first group of support and attachment feet (10) and comprising plural projections (12") that extend up to the second group of support and attachment feet (11) whereby the plural projections (12") each extend through a passage (4") that is released between two consecutive ones of the pipes (4), for the purpose of mounting the functional module (1), by being interlocked between the two consecutive pipes (4) with locking in position by cooperation of complementary shapes.

3. The functional module according to claim 1, wherein said feet of the first and second groups of support and attachment feet (10, 11) comprise tubular eyelets for the passage of attachment screws and the offset positioning of the bridge (12) relative to said common attachment and connection plate (5).

4. The functional module according to claim 1, wherein the upper attachment feet (14) of the inlet distributor (2) that line up with the first group of support and attachment feet (10) of the holding part (9) are formed on walls of the pipes (4) as projections of material integral with the walls of the pipes (4).

5. The functional module according to claim 1, wherein the inlet distributor (2) further comprises attachment feet (14') located at the common attachment and connection plate (5) and formed integral with the common attachment and connection plate (5), whereby the attachment feet (14') correspond, at least for some, to the attachment sites (20).

6. The functional module according to claim 2, wherein the longitudinal receiving housing (13) with locking of the fuel rail (7) has, in cross-section, an oblong shape with, an introduction opening (13') that is located between bases of the feet (10) of the first group of support and attachment feet (10), forming an aligned arrangement, and the lower surface of the common attachment and connection plate (5), and, an intermediate part that houses the injectors and is used as a guide zone for the fuel rail (7) during mounting, delimited by said feet of the first group of support and attachment feet (10) and ends of the pipes (4) adjacent to the common attachment and connection plate (5), and, a bottom housing location for receiving with wedging the fuel rail (7), where said bottom housing location is defined by cooperation of an inside impression (12''') of the wing-shaped body (12') that extends laterally at the feet of the first group of support and attachment feet (10) and portions of wall (15') of the ends of the pipes (4) that are close to the common attachment and connection plate (5).

7. The functional module according to claim 6, wherein the intake manifold (2) further comprises flow regulating elements (6) that regulate flow the each outlet opening (4'), the portions of wall (15') of the different pipes (4) form concordant lateral support zones for the fuel rail (7) in a locked state in the receiving housing (13) and correspond to wall portions of the pipes (4) proximal to the common attachment and connection plate (5), and are integral parts of a pipe formation (15) that receives a common control shaft (16) for regulating flows of different ones of the pipes (4), with the holding part (9) being equipped with a lateral flange (17) that locks the control shaft (16) in said pipe formation (15) at the opening (15") of the pipe formation (15).

8. The functional module according to claim 1, wherein the holding part (9) is, before attachment to the engine block, movable in a limited manner relative to the inlet distributor (2) in a direction that is perpendicular relative to the longitudinal direction of the receiving housing (13), thus making possible a modification of the width of said receiving housing (13) between a value that allows the introduction and the extraction of said fuel rail (7) and a value that brings about a locking of the fuel rail (7) in said housing (13) in the mounted position of said fuel rail (7).

9. The functional module according to claim 1, wherein the holding part (9) is made of a single piece of a molded material, and wherein the inlet distributor (2) comprises at least two complementary parts (2' and 2") made of molded material and assembled at complementary peripheral pointing zones.

10. The functional module according to claim 1, wherein the common attachment and connection plate (5) comprises a separate, injection molded thermoplastic material part, integrating at least the ends of the pipes (4) and assembled in an airtight manner with a body of the inlet distributor (2), with the inlet distributor (2) being equipped with complementary portions of said pipes (4).

11. The functional module according to claim 2, wherein the wing-shaped body (12') comprises an inside impression (12'") that forms, by cooperation with ends of the first group of support and attachment feet (10), a receiving site with locking for the fuel rail (7), allowing production of a structural unit by mechanical assembly of the holding part (9) and the fuel rail (7).

12. The functional module according to claim 1, wherein a weld or brazing connects the holding part (9) and the fuel rail (7) as a structural unit, with the fuel rail (7) and at least partially the holding part (9) being made of a metal material.

13. A vehicle with an internal combustion engine in combination with the functional module according to claim 1.

14. A process for the production of a functional module according to claim 1, comprising the steps of:

producing separately, the inlet distributor (2), the fuel rail (7), and the holding part (9), assembling the holding part (9) with the distributor (2) by introducing each of feet of the second group of the support and attachment feet (11) into a corresponding space or passage (4") that is released between two of the pipes (4) in a pivoting movement in such a way as to end in i) an interlocking of said feet of the second group of the support and attachment feet (11) and the respective adjacent projections (12") between the two pipes (4) and ii) formation of the longitudinal receiving housing (13) with an oblong cross-section for receiving the fuel rail (7) between the first group of support and attachment feet (10), a portion (15') of a common lateral wall of the ends of the pipes (4), the common attachment and connection plate (5), and a wing-shaped body (12') of the bridge of the holding part (9), to introduce the fuel rail (7) at the bottom of said longitudinal housing (13), with the bottom of said longitudinal housing (13) having a width that is greater than a diameter of said rail (7), and, to move the holding part (9) and the inlet distributor (2) relative to one another to reduce the width of the longitudinal receiving housing (13) and thus to lock the fuel rail (7) at the bottom of the longitudinal receiving housing (13).

15. The process for the production of a functional module according to claim 10, comprising the steps of:

producing producing separately, the inlet distributor (2), the fuel rail (7), and the holding part (9), forming a premounted unit (19) by assembly of the fuel rail (7) with the holding part (9), and assembling the premounted unit (19) with the distributor (2) or the plate (5) by introducing each of the feet of the second group of support and attachment feet (11) into a corresponding space (4") that is released between two of the pipes (4) in a pivoting movement in such a way as to end in i) an interlocking with locking of said feet of the second group of the support and attachment feet (11) and the respective adjacent projections (12") between the two pipes (4) and ii) formation of the longitudinal receiving housing (13) with an oblong cross-section for receiving the fuel rail (7) between the first group of support and attachment feet (10), with a portion (15') of a common lateral wall of the ends of the pipes (4), the common attachment and connection plate (5), and a wing-shaped body (12') of the bridge (12) of the holding part (9).

16. A process for production according to claim 15, wherein the production of the premounted unit (19) comprises mechanically assembling by interlocking the fuel rail (7) with the holding part (9) at a receiving site with locking of the holding part (9).

17. A process for production according to claim 15, wherein the production of the premounted unit (19) comprises assembling by welding or brazing the fuel rail (7) with the holding part (9) at the wing-shaped body (12').

18. A process according to claim 14, further comprising, prior to the assembly of the holding part (9) or the premounted unit (19) with the distributor (2) or the plate (5), in installing regulating elements, in the ends of the pipes (4) through the holding plate (5), and then in introducing a common control shaft (16) longitudinally into a pipe formation (15) that passes through the pipes (4).

19. A process according to claim 14, wherein the holding part (9) is formed by a single piece by molding, of thermoplastic or metal material, and wherein the inlet distributor (2) is formed by assembling at least two parts (2' and 2"), by welding, gluing, etc., with each of said two parts being made of a single piece by injection molding of thermoplastic material.

20. A functional module that mounts on an engine block with cylinder heads, comprising:

an inlet distributor (2);

a mixing/distribution chamber (3) integrated within the intake manifold (2);

pipes (4) integrated within the inlet distributor (2) and extending laterally from said chamber, the pipes each having an outlet opening (4'), the outlet opening (4') of each pipe being physically connected to the outlet opening (4') of the other pipes;

a common attachment and connection plate (5) formed by the connected outlet openings (4'), the common attachment and connection plate (5), when attached to the engine block, being airtight to the cylinder heads;

a high-pressure fuel rail (7) in the form of a pipe (8) with plural lateral housings (8') for injectors;

a holding part (9) locking said fuel rail (7) in position with the fuel rail (7) being held between the holding part (9) and the inlet distributor (2), the holding part (9) comprising first and second groups of support and attachment feet (10, 11) each of the attachment feet having attachment points, wherein the holding part (9), when mounted to the engine block, rests directly on and is made integral with the engine block, with the first group (10) of support and attachment feet extending on a first side of the common attachment and connection plate (5) and the second group of support and attachment feet (11) extending on a second side of the common attachment and connection plate (5);

a bridge (12) that connects the support and attachment feet (10, 11) of the first and second groups of support and attachment feet to one another, the bridge (12) being part of the holding part (9); and a longitudinal receiving housing (13) extending over an entire length of the fuel rail, the receiving housing formed by cooperation of i) at least a portion of said bridge (12), ii) the first group of the support and attachment feet (10) forming an alignment at a distance from the common attachment and connection plate (5), and iii) wall portions (15') of the pipes (4), the fuel rail (7) being received and locked in the receiving housing (13), wherein the inlet distributor (2) is equipped, i) at the common attachment and connection plate (5), with sites (20) for attachment on the engine block, said sites (20) being separate from the attachment points of the first and second groups of support and attachment feet (10, 11), and ii) upper attachment feet (14) that extend a distance from the common attachment and connection plate (5) and line up with and come to rest on the first group of support and attachment feet (10) when, in an assembled state of the functional module (1) being mounted to the engine block, the fuel rail (7) not participating in the attachment of the inlet distributor (2) to the engine block.

* * * * *